US011390077B2

(12) United States Patent
Kaneko et al.

(10) Patent No.: US 11,390,077 B2
(45) Date of Patent: Jul. 19, 2022

(54) FLUID DISCHARGE HEAD AND RECORDING DEVICE

(71) Applicant: KYOCERA Corporation, Kyoto (JP)

(72) Inventors: Yusaku Kaneko, Kirishima (JP); Wataru Ikeuchi, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 17/256,028

(22) PCT Filed: Jun. 24, 2019

(86) PCT No.: PCT/JP2019/024944
§ 371 (c)(1),
(2) Date: Dec. 24, 2020

(87) PCT Pub. No.: WO2020/004324
PCT Pub. Date: Jan. 2, 2020

(65) Prior Publication Data

US 2021/0122160 A1 Apr. 29, 2021

(30) Foreign Application Priority Data

Jun. 29, 2018 (JP) ..... JP2018-124728

(51) Int. Cl.
*B41J 2/14* (2006.01)

(52) U.S. Cl.
CPC ..... *B41J 2/14201* (2013.01); *B41J 2/14451* (2013.01); *B41J 2002/14306* (2013.01); *B41J 2002/14419* (2013.01); *B41J 2202/12* (2013.01)

(58) Field of Classification Search
CPC ..... B41J 2/14201; B41J 2/14451; B41J 2/14209; B41J 2002/14306; B41J 2202/12; B41J 2002/14419; B41J 2/18; B41J 2002/14225; B41J 2002/14459
See application file for complete search history.

(56) References Cited

U.S. PATENT DOCUMENTS

2011/0148988 A1 6/2011 Hoisington et al.
2017/0239947 A1 8/2017 Kobayashi et al.

FOREIGN PATENT DOCUMENTS

GB 2497672 A 6/2013
JP 2009-143168 A 7/2009
JP 2013-043397 A 3/2013
(Continued)

*Primary Examiner* — Kristal Feggins
(74) *Attorney, Agent, or Firm* — Volpe Koenig

(57) ABSTRACT

A first channel member of a fluid discharge head includes a plurality of discharge holes, a plurality of pressurization chambers individually linked to the discharge holes, and first and second shared channels linked to the pressurization chambers. The first shared channel opens at a plurality of first openings linked to the pressurization chambers, includes a first connection region that is a range of distribution of the plurality of first openings in the channel direction of the first shared channel. The second shared channel opens at a plurality of second openings linked to the plurality of pressurization chambers. The second shared includes a second connection region that is a range of distribution of the plurality of second openings in the channel direction of the second shared channel. The first channel member further includes a bypass channel linked to the first and second connection regions in parallel with the pressurization chambers.

18 Claims, 8 Drawing Sheets

(56) References Cited

FOREIGN PATENT DOCUMENTS

| | | | |
|---|---|---|---|
| JP | 2014-054844 | A | 3/2014 |
| JP | 2017-140806 | A | 8/2017 |
| WO | 2015/022833 | A1 | 2/2015 |
| WO | 2016/152799 | A1 | 9/2016 |

FLUID DISCHARGE HEAD AND RECORDING DEVICE

TECHNICAL FIELD

The present disclosure relates to a fluid discharge head and a recording device.

BACKGROUND ART

As a printing head, for example, there is a fluid discharge head that performs various types of printing by discharging a fluid onto a recording medium. In the fluid discharge head, for example, a large number of discharge holes through which a fluid is discharged are disposed to spread two-dimensionally. Droplets of a fluid discharged through the discharge holes land side by side on a recording medium, and printing is thereby performed (refer to, for example, PTL 1).

CITATION LIST

Patent Literature

PTL 1: Japanese Unexamined Patent Application Publication No. 2009-143168

SUMMARY OF INVENTION

A fluid discharge head according to one aspect of the present disclosure includes a channel member and a plurality of pressurization portions. The channel member includes a plurality of discharge holes, a plurality of pressurization chambers individually linked to the plurality of discharge holes, a first shared channel linked to the plurality of pressurization chambers, and a second shared channel linked to the plurality of pressurizing chambers. The plurality of pressurization portions individually pressurizes the plurality of pressurization chambers. The first shared channel opens at a plurality of first openings linked to the plurality of pressurization chambers. The first shared channel includes a first connection region that is a range of distribution of the plurality of first openings in a channel direction of the first shared channel. The second shared channel opens at a plurality of second openings linked to the plurality of pressurization chambers. The second shared channel includes a second connection region that is a range of distribution of the plurality of second openings in a channel direction of the second shared channel. The channel member further includes a bypass channel linked to the first connection region and the second connection region to be in parallel with the plurality of pressurization chambers.

DESCRIPTION OF EMBODIMENTS

Figure 1A:
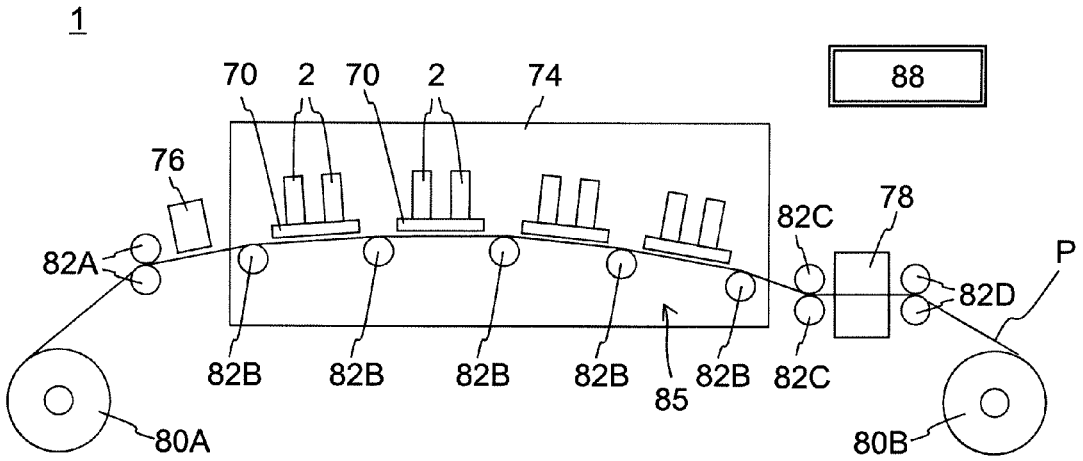
FIG. 1A is a side view of a recording device including a fluid discharge head according to one embodiment of the present disclosure.

Hereinafter, an embodiment of the present disclosure will be described with reference to the drawings. The drawings used for the following description are schematically drawn, and dimensional ratios and the like in the drawings are not necessarily in coincidence with actual dimensional ratios and the like. To exaggerate shapes and the like, the dimensional ratios and the like are also sometimes not in coincidence with each other between the drawings in which identical members are illustrated.

[Overall Configuration of Printer]

Figure 1B:
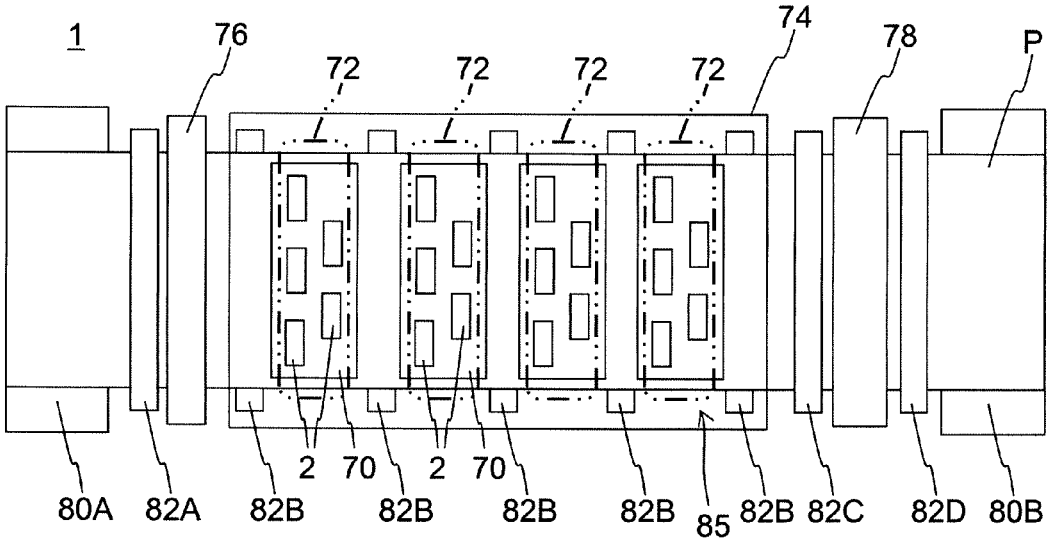
FIG. 1B is a plan view thereof.

FIG. 1A is a schematic side view of a color inkjet printer 1 (hereinafter sometimes simply referred to as the printer), which is a recording device including a fluid discharge head 2 (hereinafter sometimes simply referred to as the head) according to one embodiment of the present disclosure. FIG. 1B is a schematic plan view thereof. The printer 1 transports a print sheet P, which is a recording medium, from a feed roller 80A to a collection roller 80B, thereby relatively moving the print sheet P with respect to the head 2. The feed roller 80A, the collection roller 80B, and later-described various types of rollers constitute a moving portion 85 that relatively moves the print sheet P and the heads 2. A control portion 88 controls the head 2 on the basis of print data or the like, which is data of images, characters, and the like to cause a fluid to be discharged toward the print sheet P and droplets to land on the print sheet P, thereby performing recording, such as printing, with respect to the print sheet P.

In the present embodiment, the head 2 is fixed to the printer 1, and the printer 1 is a so-called line printer. An example of another embodiment of the recording device is a so-called serial printer that moves the head 2 by, for example, reciprocating the head 2 in an intersecting direction with respect to a transport direction of the print sheet P, for example, in a substantially orthogonal direction and alternately performs an operation of discharging droplets at an intermediate point of the movement and transportation of the print sheet P.

Four head mounting frames 70 (hereinafter sometimes simply referred to as the frames) each having a flat plate shape are fixed to the printer 1 to be substantially parallel to the print sheet P. Each of the frames 70 has five holes (not illustrated), and five heads 2 are mounted at the parts of respective holes. The five heads 2 mounted on one frame 70 constitute one head group 72. The printer 1 includes four head groups 72, and twenty heads 2 in total are mounted.

The heads 2 mounted on the frames 70 are each configured such that a part that discharges a fluid faces the print sheet P. A distance between the heads 2 and the print sheet P is, for example, about 0.5 to 20 mm.

The twenty heads 2 may be directly linked to the control portion 88 or may be connected thereto via a distribution portion that distributes print data. For example, the control portion 88 may send print data to one distribution portion, and the one distribution portion may distribute the print data to the twenty heads 2. Alternatively, for example, the control portion 88 may distribute print data to four distribution portions corresponding to four head groups 72, and each distribution portion may distribute the print data to the five heads 2 in a corresponding one of head groups 72.

The head 2 has a long shape elongated in a direction from the near side toward the far side in FIG. 1A, that is, in the up-down direction in FIG. 1B. In one head group 72, three heads are disposed side by side in an intersecting direction with respect to the transport direction of the print sheet P, for example, in a substantially orthogonal direction, and the other two heads 2 are disposed side by side in locations shifted from each other in the transport direction and one each between the three heads 2. In other expressions, the heads 2 are disposed in zigzag in one head group 72. The heads 2 are disposed such that ranges that are printable by respective heads 2 are linked to each other in the width direction of the print sheet P, that is, in an intersecting direction with respect to the transport direction of the print sheet P or such that ends of the printable ranges overlap each other. Thus, printing without gaps in the width direction of the print sheet P is enabled.

Four head groups 72 are disposed in the transport direction of the print sheet P. A fluid, for example, an ink is supplied from a fluid supply tank (not illustrated) to each of the heads 2. The heads 2 belonging to one head group 72 is configured to be supplied with an ink of the same color. Thus, printing with inks of four colors can be performed with the four head groups 72. The colors of the inks to be discharged from respective head groups 72 are, for example, magenta (M), yellow (Y), cyan (C), and black (K). A color image can be printed through printing with such inks controlled by the control portion 88.

The number of the heads 2 mounted on the printer 1 may be one when printing with a single color is to be performed with respect to a range that is printable by one head 2. The number of the heads 2 included in the head group 72 and the number of the head groups 72 are changeable, as appropriate, depending on a print object and printing conditions. For example, the number of the head groups 72 may be increased to further perform printing with multiple colors. When a plurality of the head groups 72 that perform printing with the same color is disposed and alternately performs printing in the transport direction, the transport speed can be increased even when the heads 2 having the same performance are used. Consequently, a print area per hour can be increased. A plurality of the head groups 72 that performs printing with the same color may be prepared and disposed to be shifted from each other in an intersecting direction with respect to the transport direction, and resolution in the width direction of the print sheet P may be increased.

In addition to printing with color inks, printing with a fluid, such as a coating agent, may be performed by the heads 2 uniformly or through patterning to perform surface treatment of the print sheet P. When a recording medium into which a fluid does not easily permeate is used, for example, a coating agent that forms a fluid receptor layer is usable to ease fixing of a fluid. When a recording medium into which a fluid easily permeates is used, another coating agent that forms a fluid permeation suppressing layer is usable to suppress a smear of a fluid from becoming excessively large and to suppress the fluid from mixing with another fluid that has landed next to the fluid. In addition to printing with the heads 2, the coating agent may be uniformly applied by an applicator 76 controlled by the control portion 88.

The printer 1 performs printing with respect to the print sheet P, which is a recording medium. The print paper P is in a state of being wound by a feed roller 80A. The print sheet P that is fed out from the feed roller 80A passes under the heads 2 mounted on the frames 70, then passes between two transport rollers 82C, and is eventually collected by the collection roller 80B. For printing, the transport rollers 82C are rotated, and the print sheet P is thereby transported at a constant speed and subjected to printing with the heads 2.

Next, details of the printer 1 will be described in an order in which the print sheet P is transported. The print sheet P that has been fed out from the feed roller 80A passes under the applicator 76 after passing between two guide rollers 82A. The applicator 76 applies the aforementioned coating agent onto the print sheet P.

The print sheet P next enters a head chamber 74 that houses the frames 70 on which the heads 2 are mounted. The head chamber 74 is linked to the outside at a portion, such as a part through which the print sheet P enters and exits. However, the head chamber 74 is generally a space isolated from the outside. In the head chamber 74, control factors, such as temperature, humidity, atmospheric pressure, and the like are controlled, as necessary, by the control portion 88 and the like. In the head chamber 74, an influence of disturbance can be reduced compared with the outside where the printer 1 is installed. It is thus possible to reduce the ranges of variations of the above-described control factors compared with the outside.

Five guide rollers 82B are disposed in the head chamber 74. The print sheet P is transported above the guide rollers 82B. As viewed from a side, the five guide rollers 82B are disposed in a shape protruding at a center portion toward a direction where the frames 70 are disposed. Consequently, the print sheet P that is transported above the five guide rollers 82B has an arc shape as viewed from a side. The print sheet P between the guide rollers 82B is stretched to be planar in response to application of tension to the print sheet P. One frame 70 is disposed between two guide rollers 82B. The frames 70 are installed at slightly different angles to be parallel to the print sheet P that is transported under the frames 70.

The print sheet P that has exited to the outside from the head chamber 74 passes between the two transport rollers 82C, passes inside a dryer 78, passes between two guide rollers 82D, and is collected by the collection roller 80B. The transport speed of the print sheet P is, for example, 100 m/min. Each of the rollers may be controlled by the control portion 88 or may be manually operated by a person.

Due to drying by the dryer 78, it is possible to suppress, at the collection roller 80B, layers of the print sheet P wound to be superposed on each other from easily adhering to each other and an undried fluid from being rubbed. To perform printing at a high speed, drying is also to be performed quickly. To perform drying quickly, the dryer 78 may perform drying sequentially by multiple drying methods or may perform drying by multiple drying methods in combination. Drying methods to be used in such a situation are, for example, blowing of warm air, irradiation of an infrared ray, and contact with a heated roller. When irradiation of an infrared ray is performed, an infrared ray in a specific frequency range may be applied to perform drying quickly while reducing damage to the print sheet P. When the print sheet P is made to be in contact with a heated roller, the print sheet P may be transported along the cylindrical surface of the roller to thereby increase a period of time during which heat is transmitted. A range in which the print sheet P is transported along the cylindrical surface of the roller is preferably ¼ or more the circumference of the cylindrical surface of the roller and more preferably ½ or more the circumference of the cylindrical surface of the roller. When printing with a UV curable ink or the like is performed, a UV irradiation light source may be disposed as an alternative to the dryer 78 or in addition to the dryer 78. The UV irradiation light source may be disposed between the frames 70.

The printer 1 may include a cleaning portion that cleanses the heads 2. The cleaning portion performs cleansing by, for example, wiping and capping. In wiping, for example, a surface of a part through which a fluid is to be discharged, for example, a discharge hole surface 4-2 (described later) is rubbed with a flexible wiper to thereby remove a fluid adhering to the surface. Cleansing by capping is performed, for example, as follows. First, a cap is placed (this is called capping) so as to cover a part through which a fluid is to be discharged, for example, the discharge hole surface 4-2, thereby forming a space substantially sealed by the discharge hole surface 4-2 and the cap. In such a state, discharging of a fluid is repeated, thereby removing a fluid having higher viscosity than in a normal state, foreign matters, and the like that have been stuffed in a discharge hole 8 (described later). As a result of capping being performed, it is possible to suppress the fluid during cleansing from easily dispersing in the printer 1 and the fluid from easily adhering to the print sheet P and a transport mechanism, such as the rollers. The cleansed discharge hole surface 4-2 may be further subjected to wiping. Cleansing by wiping and capping may be performed by a person through manual operation of a wiper and a cap mounted on the printer 1 or may be performed automatically by the control portion 88.

In addition to the print sheet P, a rolled fabric or the like may be employed as a recording medium. As an alternative to transporting the print sheet P directly, the printer 1 may transport a transport belt directly and transport a recording medium placed on the transport belt. As a result, a piece of paper, a cut fabric, a wood material, a tile, and the like can be recording media. The heads 2 may discharge a fluid containing conductive particles, thereby printing a wiring pattern and the like of an electronic device. The heads 2 also may discharge a predetermined amount of a fluid chemical agent or a fluid containing a chemical agent toward a reaction container and the like to cause a reaction, thereby producing a chemical product.

A position sensor, a speed sensor, a temperature sensor, and the like may be mounted on the printer 1, and the control portion 88 may control each portion of the printer 1 in accordance with a state of each portion of the printer 1 known from information from each sensor. For example, when the temperature of the heads 2, the temperature of the fluid in the fluid supply tank that supplies the fluid to the heads 2, a pressure applied by the fluid in the fluid supply tank to the heads 2, and the like influence the discharging characteristics, that is, the discharge amount, the discharge speed, and the like of the fluid to be discharged, a drive signal for discharging the fluid may be changed in accordance with information thereof.

[Fluid Discharge Head]

Figure 2A:
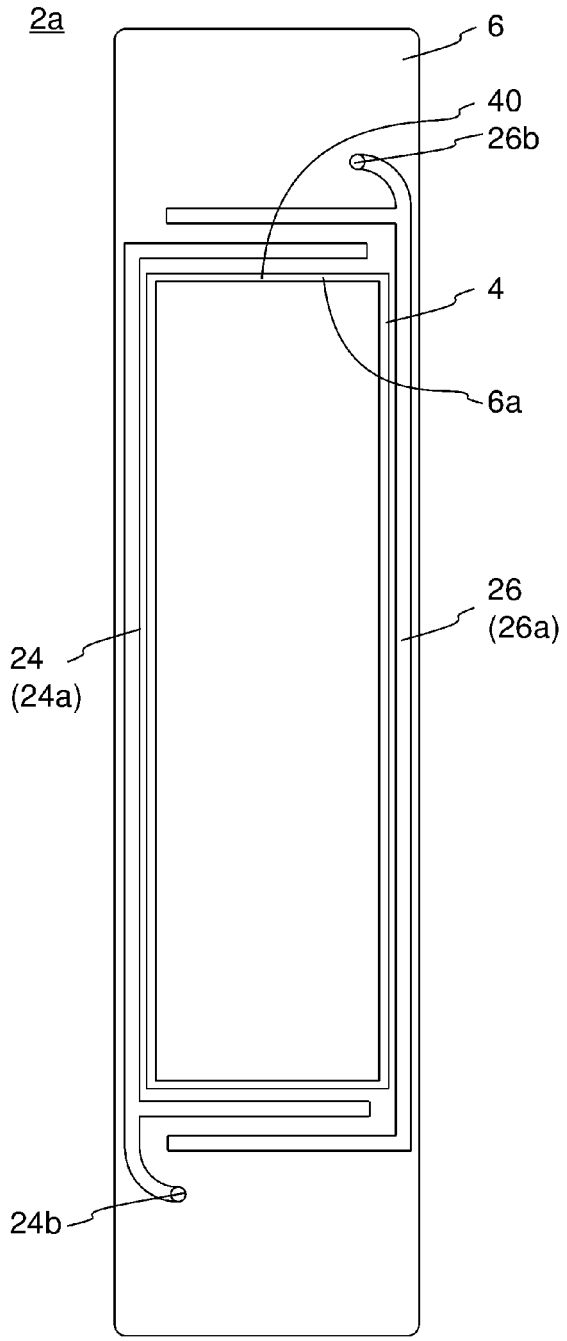
FIG. 2A is a plan view of a head body, which is a main portion of the fluid discharge head in FIG. 1.
Figure 2B:
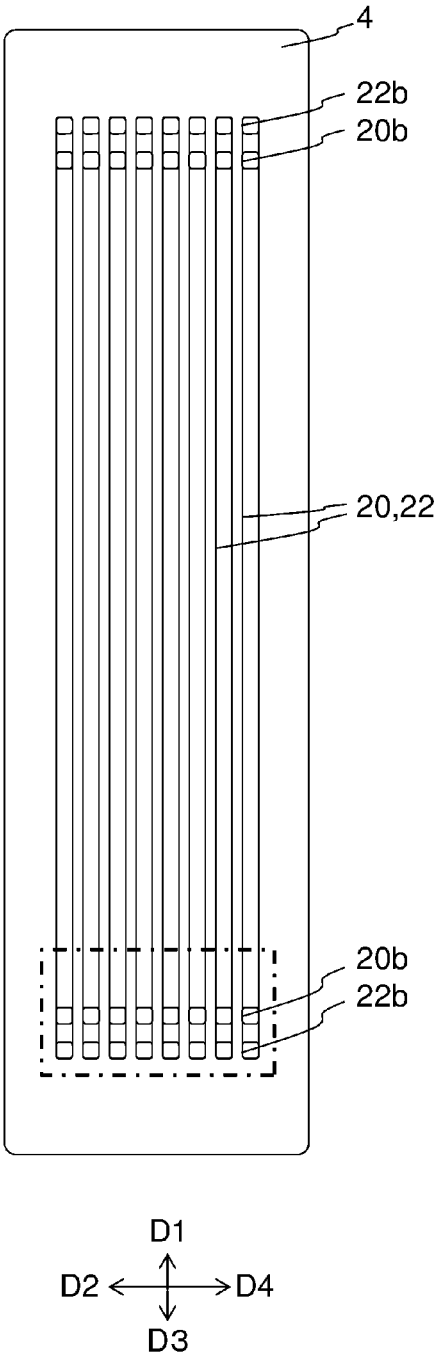
FIG. 2B is a plan view in which a second channel member is removed from FIG. 2A.
Figure 3:
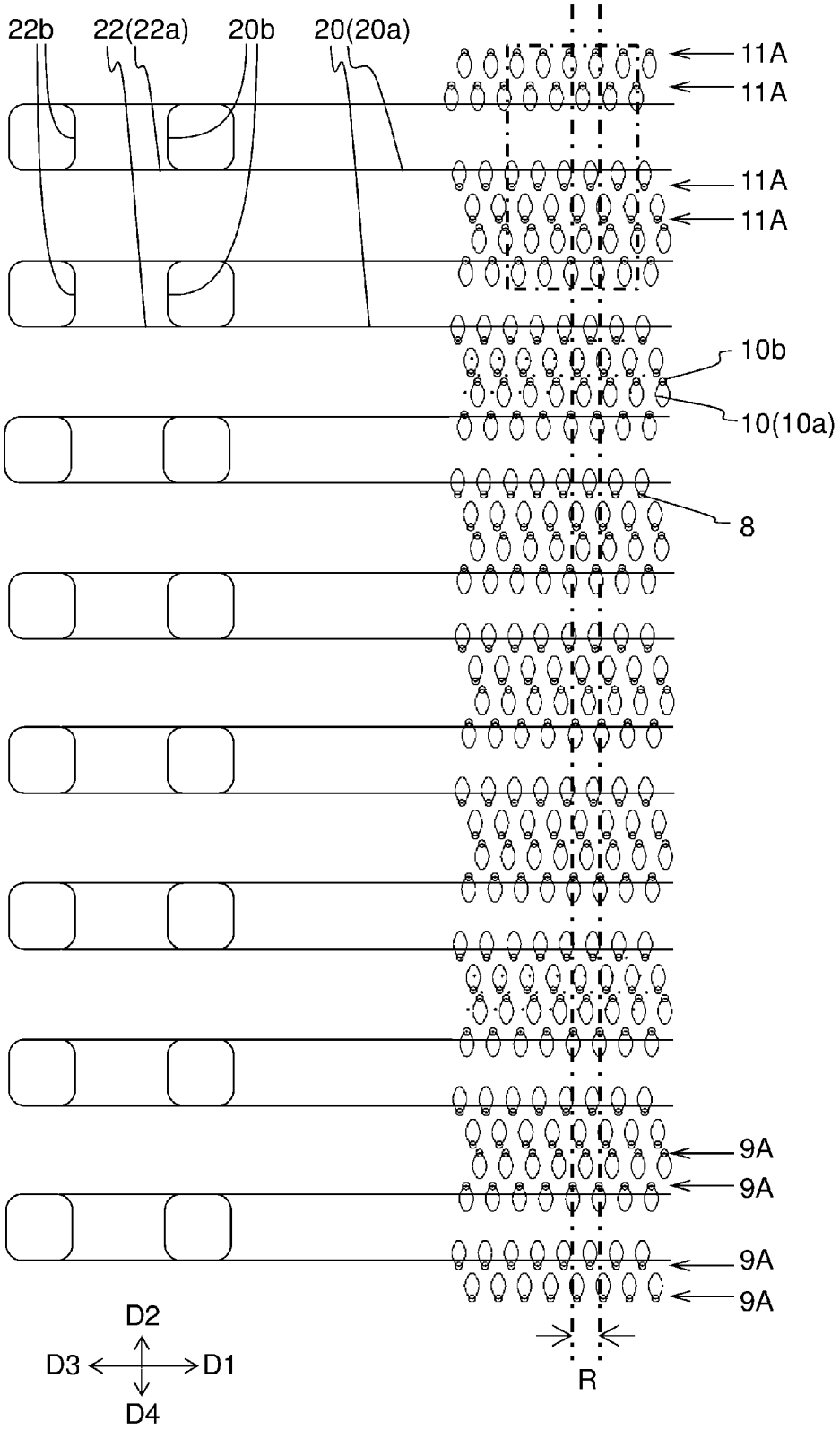
FIG. 3 is an enlarged plan view of a portion of FIG. 2B.
Figure 4:
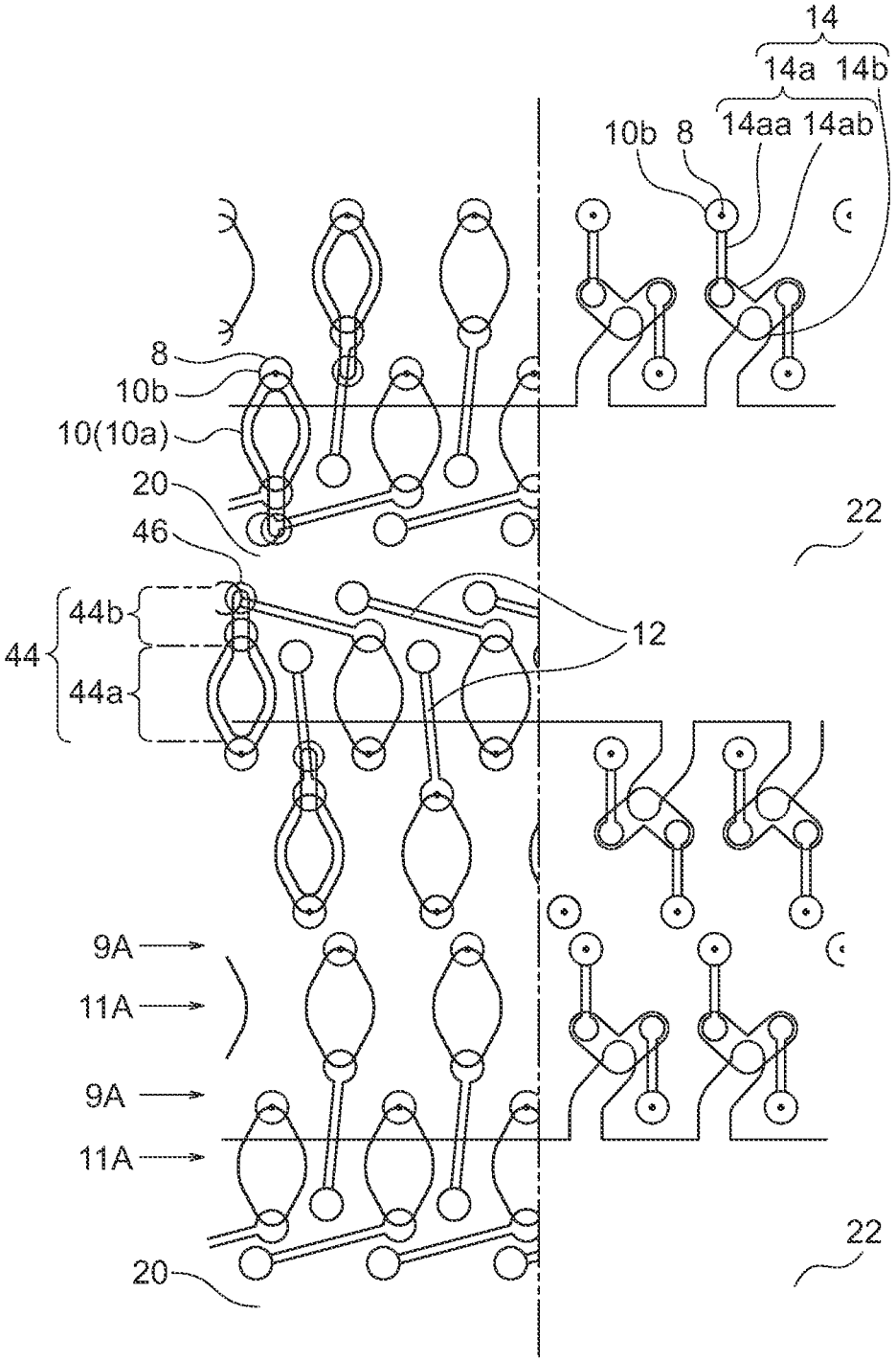
FIG. 4 is an enlarged plan view of a portion of FIG. 3.
Figure 5A:
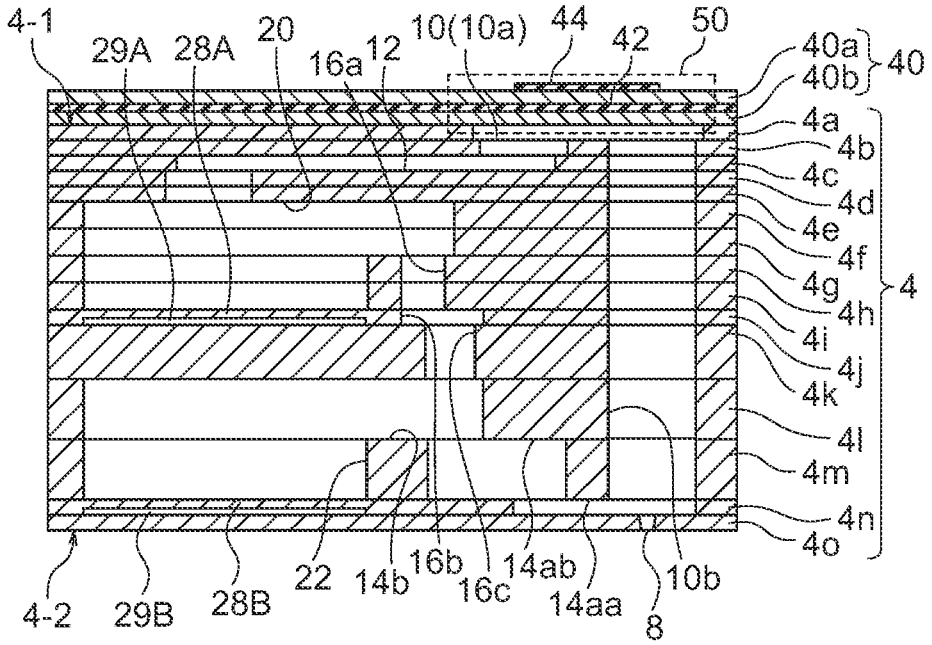
FIG. 5A is a schematic partial longitudinal sectional view of the head body.
Figure 5B:
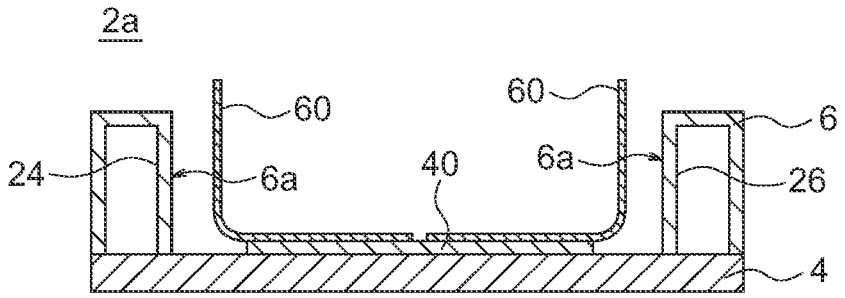
FIG. 5B is a longitudinal sectional view of another portion of the head body.
Figure 6:
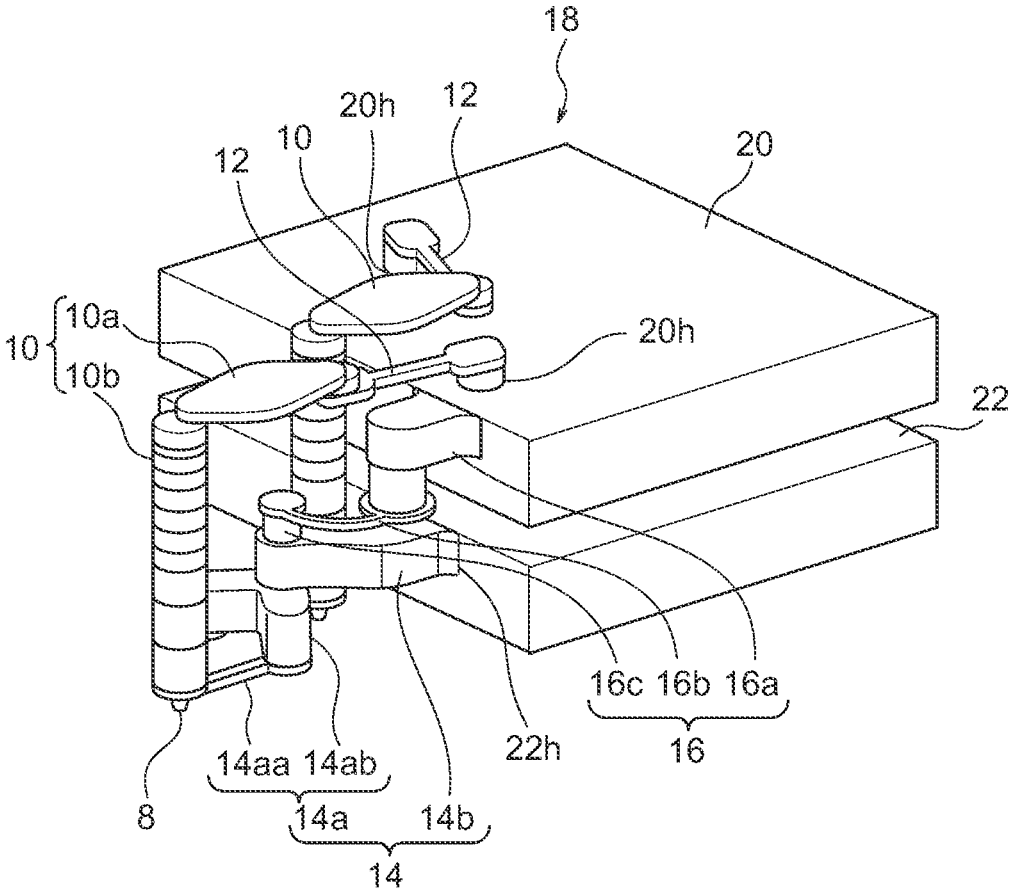
FIG. 6 is a schematic perspective view of a portion of a channel of the head body.

Next, the fluid discharge head 2 according to one embodiment of the present disclosure will be described. FIG. 2A is a plan view of a head body 2*a*, which is a main portion of the head 2 illustrated in FIG. 1. FIG. 2B is a plan view of a state in which a second channel member 6 is removed from the head body 2*a*. FIG. 3 is an enlarged plan view of the head body 2*a* in a range indicated by the one-dot chain line in FIG. 2B. FIG. 4 is an enlarged plan view of the head body 2*a* in a range indicated by the one-dot chain line in FIG. 3. FIG. 5A is a schematic partial longitudinal sectional view of the head body 2*a*. In FIG. 5A, to illustrate a linked state of channels, the channels that are not actually present on the same longitudinal section are drawn as if present on the same longitudinal section. In FIG. 5B, a signal transmission portion 60, which is not drawn in FIG. 2A, is drawn. FIG. 6 is a schematic perspective view of a portion of a channel in the head body 2*a*.

Each figure is drawn as follows for easy understanding of the drawings. In FIGS. 2 to 4, channels and the like that are present below other components and that should be drawn with broken lines are drawn with solid lines. FIG. 4 is divided by a two-dot chain line to left and right. On the left side of the two-dot chain line, a channel from a first shared channel 20 to the discharge hole 8 is drawn. On the right side of the two-dot chain line, a channel from the discharge hole 8 to a second shared channel 22 is drawn. Regarding each of four pressurization chambers 10 in an upper left part of FIG. 4, an individual electrode 44 and a connection electrode 46 are also drawn.

The head 2 may include, in addition to the head body 2*a*, a housing, a driver IC, a wiring substrate, and the like. The head body 2*a* includes a first channel member 4, a second channel member 6 that supplies a fluid to the first channel member 4, and a piezoelectric actuator substrate 40 in which a displacement element 50, which is a pressurization portion, is incorporated. The head body 2*a* has a flat plate shape elongated in one direction. The direction is sometimes referred to as the longitudinal direction. The second channel member 6 functions as a support member that supports the structure of the head body 2*a*. The head body 2*a* is fixed at each of both ends in the longitudinal direction of the second channel member 6 to the frame 70.

[First Channel Member]

The first channel member 4 that constitutes the head body 2*a* has a flat plate shape and has a thickness of about 0.5 to 2 mm. A large number of the pressurization chambers 10 are disposed side by side in a planar direction at a pressurization chamber surface 4-1, which is one surface of the first channel member 4. At the discharge hole surface 4-2 of the first channel member 4 opposite to the pressurization chamber surface 4-1, a large number of the discharge holes 8 through which a fluid is to be discharged are disposed side by side in a planar direction. The discharge holes 8 are respectively linked to the pressurization chambers 10. Hereinafter, description will be provided on the basis that the pressurization chamber surface 4-1 is located above the discharge hole surface 4-2.

At the first channel member 4, a plurality of the first shared channels 20 and a plurality of the second shared channels 22 are disposed to extend in a first direction. Hereinafter, the first shared channel 20 and the second shared channel 22 are sometimes collectively referred to as the shared channels. Each first shared channel 20 and each second shared channel 22 are disposed to be superposed on each other at at least portions thereof. The first shared channel 20 and the second shared channel 22 are superposed on each other, for example, at 80% or more of the widths thereof or superposed at all of the widths. An intersecting direction with respect to the first direction is denoted by a second direction. Eight first shared channels 20 and eight second shared channels 22 are disposed side by side in the second direction. The first direction is identical to the longitudinal direction of the head body 2*a*. A direction opposite to the first direction is denoted by a third direction, and a direction opposite to the second direction is denoted by a fourth direction. In some of the figures, the first to fourth directions are indicated by D1 to 4.

The pressurization chambers 10 linked to the first shared channels 20 and the second shared channels 22, and the discharge holes 8 linked to the pressurization chambers 10 are disposed side by side along both sides of the first shared channels 20 and the second shared channels 22. The pressurization chambers 10 linked to the first shared channels 20 and the second shared channels 22 constitute two lines of pressurization chamber lines 11A on one side of the shared channels, that is, four lines in total on both sides thereof. The discharge holes 8 linked to the first shared channels 20 and the second shared channels 22 constitute two lines of discharge hole lines 9A on one side of the shared channels, that is, four lines in total on both sides thereof. There are eight first shared channels 20 and eight second shared channels 22. Thus, there are 32 lines of the pressurization chamber lines 11A as a whole, and there are also 32 lines of the discharge hole lines 9A as a whole.

Each first shared channel 20 and the four lines of the pressurization chambers 10 disposed side by side on both sides thereof are linked to each other via a first relay channel 12. Each second shared channel 22 and the four lines of the pressurization chambers 10 disposed side by side on both sides thereof are linked to each other via a second relay channel 14.

Due to such a configuration, at the first channel member 4, a fluid that is supplied to the first shared channels 20 flows into the pressurization chambers 10 disposed side by side along the first shared channels 20. A portion of the fluid that has flowed into the pressurization chambers 10 is discharged through the discharge holes 8. The other portion of the fluid flows into the second shared channels 22 that are disposed to be superposed on the first shared channels 20 and is drained to the outside from the first channel member 4. That is, the first shared channels 20 are channels in which a fluid to be supplied to the pressurization chambers 10 flows. The first shared channels 20 can be called supply channels. The second shared channels 22 are channels in which the fluid collected from the pressurization chambers 10 flows. The second shared channels 22 can be called collection channels. The flow of supplying and collecting the fluid, including the flows described below, may be reversed.

The first shared channels 20 are disposed to be superposed on the second shared channels 22. Outside a range to which the first relay channel 12 is linked, each first shared channel 20 opens at openings 20*b* in both ends in the first direction and the third direction to the outside of the first channel member 4. Outside a range to which the second relay channel 14 is linked and on the outer side of the openings 20*b* of the first shared channel 20, each second shared channel 22 opens at openings 22*b* in both ends in the first direction and the third direction to the outside of the first channel member 4. Due to the openings 22*b* of the second shared channel 22 on the lower side being on the outer side of the openings 20*b* of the first shared channel 20 on the upper side, the space efficiency is improved. The entirety, excluding both ends, of a second shared channel body 22*a* is on the lower side of the entirety, excluding both ends, of a first shared channel body 20*a*.

Substantially identical amounts of a fluid is supplied through the openings 20*b* at the first direction end and the openings 20*b* at the third direction end of each first shared channel 20 and flows toward the center of the first shared channel 20. When the amount of the fluid discharged through the discharge hole 8 linked to one first shared channel 20 and one second shared channel 22 is substantially constant regardless of the location, the flow in the first shared channel 20 becomes slower toward the center and becomes 0 (zero) near the center. Conversely, the flow in the second shared channel 22 is 0 (zero) near the center and becomes faster toward the outer side.

The head 2 is used to record various objects. Thus, distribution of the amount of a fluid discharged through the discharge holes 8 linked to one first shared channel 20 and one second shared channel 22 is various. When the discharge amount through the discharge holes 8 at the first direction end is large, a location where the flow becomes 0 (zero) is nearer to the first direction end than the center. Conversely, when the discharge amount through the discharge holes 8 at the third direction end is large, the location where the flow becomes 0 (zero) is nearer to the third direction end than the center. Thus, the distribution of discharging changes depending on an object to be recorded, and the location where the flow becomes 0 (zero) is thereby moved. Consequently, even when the flow becomes 0 (zero) and the fluid remains at a certain moment, remaining of the fluid in the location is eliminated by the change of the distribution of discharging. It is thus possible to suppress sedimentation of pigments, adhesion of a fluid, and the like from easily occurring as a result of the fluid continuing to remain in the same location.

Due to an influence of a pressure loss, a pressure to be applied to, of the first relay channel 12 linked to the first shared channel 20, a part near the first shared channel 20 changes depending on a location (mainly, a location in the first direction) where the first relay channel 12 is linked to the first shared channel 20. Due to an influence of a pressure loss, a pressure to be applied to a part near the second relay channel 14 linked to the second shared channel 22 changes depending on a location (mainly, a location in the first direction) where the second relay channel 14 is linked to the second shared channel 22. When the pressure of the fluid in one discharge hole 8 is caused to be substantially 0 (zero), the above-described pressure change changes symmetrically. It is thus possible to cause the pressure of the fluid to be substantially 0 (zero) in all of the discharge holes 8.

A lower surface of each first shared channel 20 is a damper 28A. A surface of the damper 28A opposite to a surface thereof facing the first shared channel 20 faces a damper chamber 29A. The damper chamber 29A contains a gas, such as air, and has a volume that changes in response to a pressure applied from the first shared channel 20. The damper 28A can vibrate in response to a change in the volume of the damper chamber 29A. As a result of the vibration attenuating, a pressure variation generated in the first shared channel 20 can be attenuated. The provision of the damper 28A can reduce the pressure variation of the resonance and the like of the fluid in the first shared channel 20.

A lower surface of each second shared channel 22 is a damper 28B. A surface of the damper 28B opposite to a surface thereof facing the second shared channel 22 faces a damper chamber 29B. As with the first shared channel, the provision of the damper 28B can reduce the pressure variation of the resonance and the like of the fluid in the second shared channel 22.

At one discharge hole line 9A, the discharge holes 8 are disposed at intervals of 50 dpi (about 25.4 mm/50). There are 32 lines of the discharge hole lines 9A. The discharge holes 8 included in the discharge hole lines 9A are disposed to be shifted from each other in the first direction. Consequently, the discharge holes 8 are disposed at intervals of 1600 dpi as a whole.

Specifically, in FIG. 3, when the discharge holes 8 are projected in a direction orthogonal to the first direction, a total of 32 of the discharge holes 8 are projected in a range of a virtual straight line R. The discharge holes 8 are disposed side by side at intervals of 1200 dpi within the virtual straight line R. Consequently, when the print sheet P is transported in a direction orthogonal to the virtual straight line R and printed, printing with a resolution of 1200 dpi can be performed.

[Second Channel Member]

The second channel member 6 is joined to the pressurization chamber surface 4-1 of the first channel member 4. The second channel member 6 includes a first integrated channel 24 that supplies a fluid to the first shared channel 20, and a second integrated channel 26 that collects the fluid in the second shared channel 22. The thickness of the second channel member 6 is thicker than the thickness of the first channel member 4 and is about 5 to 30 mm.

The second channel member 6 is joined in a region where the piezoelectric actuator substrate 40 is not connected, in the pressurization chamber surface 4-1 of the first channel member 4. Specifically, the second channel member 6 is joined to surround the piezoelectric actuator substrate 40. Consequently, it is possible to suppress a portion of the discharged fluid from becoming mist and adhering to the piezoelectric actuator substrate 40. The first channel member 4 is fixed at the periphery such that the piezoelectric actuator substrate 40 is surrounded. Thus, the first channel member 4 vibrates with the drive of the displacement elements 50 and can reduce occurrence of resonance.

An opening 24*b* that opens in the upper surface of the second channel member 6 is disposed at an end of the first integrated channel 24 in the third direction. The first integrated channel 24 branches in an intermediate location into two channels. One of the channels is linked to the openings 20*b* of the first shared channels 20 at the third direction end. The other one is linked to the openings 20*b* of the first shared channels 20 at the first direction end. An opening 26*b* that opens in the upper surface of the second channel member 6 is disposed at an end of the second integrated channel 26 in the first direction. The second integrated channel 26 branches in an intermediate location into two channels. One of the channels is linked to the openings 22*b* of the second shared channels 22 at the first direction end. The other one is linked to the openings 22*b* of the second shared channels 22 at the third direction end. To perform printing, a fluid is supplied from the outside into the opening 24*b* of the first integrated channel 24. The fluid that is not discharged is collected through the opening 26*b* of the second integrated channel 26.

In the second channel member 6, a through hole 6*a* vertically passing through the second channel member 6 is disposed. The signal transmission portion 60, such as a FPC (flexible printed circuit), that transmits a drive signal for driving the piezoelectric actuator substrate 40 passes through the through hole 6*a*.

By disposing the first integrated channel 24 at the second channel member 6, which differs from the first channel member 4 and which is thicker than the first channel member 4, it is possible to increase the sectional area of the first integrated channel 24. Consequently, it is possible to reduce a difference in pressure loss due to a difference in the location where the first integrated channel 24 and the first shared channels 20 are linked to each other. The channel resistance of the first integrated channel 24 is preferably less than or equal to 1/100 the channel resistance of the first shared channels 20. The channel resistance of the first integrated channel 24 is more exactly channel resistance in a region in the first integrated channel 24 where the first integrated channel 24 is linked to the first shared channels 20.

By disposing the second integrated channel 26 at the second channel member 6, which differs from the first channel member 4 and which is thicker than the first channel member 4, it is possible to increase the sectional area of the second integrated channel 26. Consequently, it is possible to reduce a difference in pressure loss due to a difference in the location where the second integrated channel 26 and the second shared channels 22 are linked to each other. The channel resistance of the second integrated channel 26 is preferably less than or equal to 1/100 the channel resistance of the second shared channels 22. The channel resistance of the second integrated channel 26 is more exactly channel resistance in a range in the second integrated channel 26 where the second integrated channel 26 is linked to the first integrated channel 24.

The first integrated channel 24 is disposed at one end of the second channel member 6 in the short direction. The second integrated channel 26 is disposed at the other end of the second channel member 6 in the short direction. The channels are structured to each extend toward the first channel member 4 and to be linked to the first shared channels 20 and the second shared channels 22, respectively. Such a structure can increase the sectional areas of the first integrated channel 24 and the second integrated channel 26 and reduce the channel resistance. In such a structure, the first channel member 4 is fixed at the periphery thereof by the second channel member 6 and can increase rigidity. Moreover, with such a structure, the through hole 6*a* through which the signal transmission portion 60 passes can be disposed.

A groove that functions as the first integrated channel (first integrated channel body 24*a*) and a groove that functions as the second integrated channel 26 (second integrated channel body 26*a*) are disposed on the lower surface of the second channel member 6. A portion of the lower surface of the groove that functions as the first integrated channel body 24*a* is covered by the upper surface of the first channel member 4. The other portion of the lower surface is linked to the openings 20*b* of the first shared channels 20. A portion of the lower surface of the groove that functions as the second integrated channel body 26*a* is covered by the upper surface of the first channel member 4. The other portion of the lower surface is linked to the openings 22*b* of the second shared channels 22.

The first integrated channel 24 and the second integrated channel 26 may be each disposed with a damper so that supplying or draining of a fluid is stable with respect to the variation of the discharge amount of the fluid. Filters may be disposed in inner portions of the first integrated channel 24 and the second integrated channel 26 or between the first channel member 4 and the first shared channels 20 or the second shared channels 22 to suppress foreign matter and air bubbles from easily entering the first channel member 4.

[Arrangement of Drive System]

The upper surface of the second channel member 6 is covered by a metallic housing or the like. The signal transmission portion 60 is electrically connected to, for example, a wiring substrate in a housing. The wiring substrate and the control portion 88 are electrically connected to each other by a cable or the like. A driver IC that drives the displacement elements 50 may be mounted on the signal transmission portion 60. It is possible to dissipate heat generated in the driver IC to the outside by making the driver IC be in contact with a metallic housing or with a member that causes heat to be easily transmitted to the housing.

The piezoelectric actuator substrate 40 including the displacement elements 50 is joined to the pressurization chamber surface 4-1, which is the upper surface of the first channel member 4. Each displacement element 50 is disposed to be located above the pressurization chambers 10. The piezoelectric actuator substrate 40 occupies a region of a shape substantially identical to the shape of a pressurization chamber group constituted by the pressurization chambers 10. An opening of each pressurization chamber 10 is closed by the piezoelectric actuator substrate 40 being joined to the pressurization chamber surface 4-1 of the first channel member 4. The piezoelectric actuator substrate 40 has a rectangular shape elongated in the same direction as the head body 2*a*.

The signal transmission portion 60 that supplies a signal to each displacement element 50 is connected to the piezoelectric actuator substrate 40. The second channel member 6 has the through hole 6*a* at the center thereof. The through hole 6*a* passes through the second channel member 6 vertically. The signal transmission portion 60 is electrically linked to the control portion 88 through the signal transmission portion 60. When the signal transmission portion 60 has a shape that extends in the short direction from an end of one long side of the piezoelectric actuator substrate 40 toward an end of the other long side thereof such that wires disposed at the signal transmission portion 60 extend in the short direction and are arranged side by side in the longitudinal direction, a distance between the wires can be increased.

[Layered Structure of First Channel Member]

The first channel member 4 has a layered structure in which a plurality of plates is layered. In the first channel member 4, a plate 4*a* is disposed near the pressurization chamber surface 4-1, and plates 4*b* to 4*o* are sequentially layered under the plate 4*a*. The plate 4*a* that has a hole serving as a side wall of the pressurization chambers 10 is sometimes called the cavity plate 4*a*. The plates 4*f*, 4*g*, 4*h*, 4*i*, 4*l*, and 4*m* that have holes serving as side walls of the shared channels are sometimes called the manifold plates 4*f*, 4*g*, 4*h*, 4*i*, 4*l*, and 4*m*. The plate 4*o* in which the discharge holes 8 open is sometimes called the nozzle plate 4*o*. Each plate has a large number of holes and grooves. The holes and the grooves are formed by, for example, preparing each of the plates with metal and etching the plate. The thickness of each of the plates is about 10 to 300 μm, which increases accuracy in forming holes to be formed. The plates are aligned and layered such that these holes are in communication with each other and constitute the first shared channels 20 and the like.

In the pressurization chamber surface 4-1 of the flat plate-shaped first channel member 4, a pressurization chamber body 10*a* opens and the piezoelectric actuator substrate 40 is joined. In addition, the openings 20*b* through which a fluid is to be supplied to the first shared channels 20 and the openings 22*b* through which the fluid is to be collected from the second shared channels 22 open in the pressurization chamber surface 4-1. In the discharge hole surface 4-2, which is a surface opposite to the pressurization chamber surface 4-1, of the first channel member 4, the discharge holes 8 open.

[Channels Relating to Discharging]

As structures for discharging a fluid, the pressurization chambers 10 and the discharge holes 8 are present. Each pressurization chamber 10 is defined by the pressurization chamber body 10*a* that faces the displacement elements 50, and a partial channel 10*b* that links the pressurization chamber body 10*a* to the discharge holes. The pressurization chamber body 10*a* is in the cavity plate 4*a*. The partial channel 10*b* is defined as a result of the holes in the plates 4*b* to 4*n* overlapping each other and being closed (at a part other than the discharge holes 8) by the nozzle plate 4*o*.

The first relay channel 12 is linked to the pressurization chamber body 10*a*. The first relay channel 12 is linked to the first shared channels 20. The first relay channel has a circular hole passing through the plate 4*b*, an elongated through groove extending through the plate 4*c* in the planar direction, and a circular hole passing through the plates 4*d* and 4*e*.

The second relay channel 14 is linked to the partial channel 10*b*. The second relay channel 14 is linked to the second shared channels 22. The second relay channel 14 includes an individual channel 14*a* linked to one pressurization chamber 10, and a connection channel 14*b* linked also to the other pressurization chambers 10. In the present embodiment, two individual channels 14*a* respectively linked to two pressurization chambers 10 are combined with each other, become one connection channel 14*b*, and are then linked to the second shared channels 22. The number of the connection channels 14*b* linked to one second shared channel 22 is plural. The number of the connection channels 14*b* linked to one second shared channel 22 is half the number of the pressurization chambers 10 linked to one second shared channel 22. After being bound into the connection channel 14*b*, a plurality of individual channels 14*a* is linked to the second shared channels 22, and the space efficiency is thereby improved. The number of the individual channels 14*a* linked to the connection channel 14*b* may be three or more.

It may be regarded that two second relay channels 14 are disposed for two pressurization chambers 10 and share one connection channel 14*b* or regarded that one second relay channel 14 is disposed for two pressurization chambers 10 and one second relay channel 14 includes two individual channels 14*a*. The present embodiment will be described by using mainly expressions based on the former.

The first shared channels 20 are each defined as a result of the holes in the plates 4*f* to 4*i* overlapping each other with the upper end thereof being closed by the plate 4*e* and the lower end thereof being closed by the plate 4*j*. The second shared channels 22 are each defined as a result of the holes in the plates 4*l* and 4*m* overlapping each other with the upper end thereof being closed by the plate 4*k* and the lower end thereof being closed by the plate 4*n*.

The flow of a fluid will be described in short as follows. A fluid supplied to the first integrated channel 24 enters the pressurization chambers 10 by sequentially passing through the first shared channel 20 and the first relay channel 12, and a portion of the fluid is discharged through the discharge hole 8. The fluid that is not discharged enters the second shared channel 22 through the second relay channel 14, then enters the second integrated channel 26, and is drained to the outside of the head body 2*a*.

[Structure of Piezoelectric Actuator Substrate]

The piezoelectric actuator substrate 40 has a layered structure constituted by two piezoelectric ceramic layers 40*a* and 40*b*, which are piezoelectric bodies. These piezoelectric ceramic layers 40*a* and 40*b* each have a thickness of about 20 In other words, the thickness of the piezoelectric actuator substrate 40 between the upper surface of the piezoelectric ceramic layer 40*a* and the lower surface of the piezoelectric ceramic layer 40*b* is about 40 The ratio between the thicknesses of the piezoelectric ceramic layer 40*a* and the piezoelectric ceramic layer 40*b* is 3:7 to 7:3 and, preferably, 4:6 to 6:4. The piezoelectric ceramic layers 40*a* and 40*b* each extend across a plurality of the pressurization chambers 10. The piezoelectric ceramic layers 40*a* and 40*b* are constituted by, for example, a ferroelectric ceramic material of lead zirconate titanate (PZT), $NaNbO_3$, $BaTiO_3$, $(BiNa)NbO_3$, $BiNaNb_5O_{15}$, or the like. In the present embodiment, the piezoelectric ceramic layer 40*b* acts as a vibration plate and does not directly piezoelectrically deforms. As a vibration plate, non-piezoelectric ceramics, metal plates, or the like may be used instead of the piezoelectric ceramic layer 40*b*.

The piezoelectric actuator substrate 40 includes a shared electrode 42 constituted by a metal material of Ag—Pd or the like and the individual electrode 44 constituted by a metal material of Au or the like. The thickness of the shared electrode 42 is about 2 μm. The thickness of the individual electrode 44 is about 1 μm.

The individual electrode 44 is disposed in each of locations facing the pressurization chambers 10 in the upper surface of the piezoelectric actuator substrate 40. The individual electrode 44 includes an individual electrode body 44*a* having a planar shape slightly smaller than that of the pressurization chamber body 10*a* and has a shape substantially similar to that of the pressurization chamber body 10*a*, and an extraction electrode 44*b* extracted from the individual electrode body 44*a*. The extraction electrode 44*b* includes a part extracted at one end to the outside of a region facing the pressurization chamber 10. The connection electrode 46 is disposed at the extracted part. The connection electrode 46 is, for example, a conductive resin containing conductive particles, such as silver particles and has a thickness of about 5 to 200 μm. The connection electrode 46 is electrically joined to an electrode disposed at the signal transmission portion 60.

A drive signal is to be supplied to the individual electrode 44 from the control portion 88 through the signal transmission portion 60, which will be described later in detail. The drive signal is supplied periodically in synchronization with the transport speed of the print sheet P.

The shared electrode 42 is in a region between the piezoelectric ceramic layer 40*a* and the piezoelectric ceramic layer 40*b* substantially throughout the entire surface in the surface direction. That is, the shared electrode 42 extends to cover all of the pressurization chambers 10 in the region facing the piezoelectric actuator substrate 40. The shared electrode 42 is linked via a through conductor passing through the piezoelectric ceramic layer 40*a* to a shared-electrode-use surface electrode (not illustrated) on the piezoelectric ceramic layer 40*a* in a location avoiding an electrode group constituted by the individual electrodes 44. The shared electrode 42 is grounded via the shared-electrode-use surface electrode and retained at a ground potential. As with the individual electrode 44, the shared-electrode-use surface electrode is connected to the control portion 88 directly or indirectly.

The piezoelectric ceramic layer 40*a* includes a part between the individual electrode 44 and the shared electrode 42. The part is polarized in the thickness direction and serves as the displacement element 50 that has a unimorph structure and that is displaced when a voltage is applied to the individual electrode 44. Specifically, with the individual electrode 44 caused to have a potential that differs from the potential of the shared electrode 42, when an electric field is applied to the piezoelectric ceramic layer 40*a* in the polarized direction, a part to which the electric field is applied acts as an active part that is to be distorted by a piezoelectric effect. In this configuration, when the individual electrode 44 is caused to have a predetermined positive or negative potential with respect to the shared electrode 42 by the control portion 88 so that the electric field and the polarization are in the same direction, a part (active part) of the piezoelectric ceramic layer 40*a* between the electrodes contracts in the surface direction. As the piezoelectric ceramic layer 40*b*, which is an inactive layer, does not receive the influence of the electric field, the piezoelectric ceramic layer does not contract spontaneously and attempts to restrict the deformation of the active part. As a result, a difference in distortion in the polarized direction is generated between the piezoelectric ceramic layer 40*a* and the piezoelectric ceramic layer 40*b*, which causes the piezoelectric ceramic layer 40*b* to deform (unimorph deformation) to protrude toward the pressurization chamber 10.

[Discharging Operation]

Next, an operation of discharging a fluid will be described. The displacement elements 50 are driven (displaced) by the drive signal supplied to the individual electrode 44 via the driver IC and the like in response to the control by the control portion 88. In the present embodiment, various drive signals are usable to discharge a fluid. Here, a so-called pulling driving method will be described.

The individual electrode 44 is previously caused to have a higher potential (hereinafter referred to as the high potential) than the shared electrode 42. The individual electrode 44 is caused to have the same potential (hereinafter referred to as the low potential) as the shared electrode 42 every time when discharging is requested and is then caused to have the high potential again at a predetermined time. Consequently, at the time when the individual electrode 44 is caused to have the low potential, the piezoelectric ceramic layers 40*a* and 40*b* (start to) return to the original (flat) shapes, and the volume of each pressurization chamber 10 increases compared with that in an initial state (a state in which the potentials of the two electrodes differ from each other). Consequently, a negative pressure is applied to the fluid in each pressurization chamber 10. Then, the fluid in each pressurization chamber 10 starts to vibrate at a specific period of vibration. Specifically, first, the volume of each pressurization chamber 10 starts to increase, and the negative pressure gradually decreases. Next, the volume of each pressurization chamber 10 becomes maximum, and the pressure becomes substantially zero. Next, the volume of each pressurization chamber 10 starts to decrease, and the pressure increases. Then, at a time when the pressure becomes substantially maximum, the individual electrode 44 is caused to have the high potential. Thus, a vibration applied first and a vibration applied subsequently overlap, and a larger pressure is applied to the fluid. The pressure is propagated in the partial channel 10*b* and causes the fluid to be discharged through the discharge holes 8.

In other words, it is possible to discharge droplets by supplying a drive signal of a pulse that causes the individual electrode 44 to have the low potential, based on the high potential, for a certain period to the individual electrode 44. When the width of the pulse is set to an AL (acoustic length), which is a period of time half the specific period of vibration of the fluid in each pressurization chamber 10, it is possible in principle to maximize the discharge speed and the discharge amount of the fluid. The specific period of vibration of the fluid in each pressurization chamber 10 is greatly influenced by the physical properties of the fluid and the shape of each pressurization chamber 10. In addition to those, the physical properties of the piezoelectric actuator substrate 40 and the characteristics of the channels linked to the pressurization chambers 10 also influence the specific period of vibration.

[Details of Relay Channel]

To supply a fluid to be discharged, each first shared channel 20 preferably has a large sectional area. To cause a circulating fluid to flow, each second shared channel 22 also preferably has a sectional area that is large to a certain extent. Meanwhile, when the sectional areas of the shared channels are increased, the width of the head body 2*a* in the short direction increases, which increases a range in which the discharge holes 8 are distributed in the short direction. When the distributed range of the discharge holes 8 in the short direction increases, printing accuracy when the installation angle of the head 2 is shifted so as to rotate in the planar direction is greatly degraded, which is not desirable.

The arrangement interval of the shared channels is reduced to increase the sectional areas of the shared channels without greatly increasing the width of the head body 2*a* in the short direction. When the space efficiency of the arrangement of the channels between the shared channels is improved, the arrangement interval of the shared channels can be reduced. The second relay channels 14 are channels connected near the discharge holes 8 of the pressurization chambers 10. Thus, when the space efficiency of the arrangement of the second relay channels 14 is improved, the arrangement interval of the shared channels can be reduced.

To reduce differences in discharging characteristics among droplets discharged through the discharge holes 8, it is preferable that differences in channel characteristics among the second relay channels 14 be small. Therefore, it is preferable that the second relay channels 14 be designed to have substantially identical sectional areas and substantially identical lengths. In addition, the second relay channels 14 preferably have channel characteristics suitable for discharging. There are a specific sectional area and a specific length that are suitable to have the channel characteristics. If the purpose is only simply improve the space efficiency, for example, a channel that linearly links with the shortest distance may be disposed. It is however difficult with such a channel to obtain the channel characteristics described above.

Thus, the pressurization chambers 10 and the second shared channels 22 are not linked to each other by a completely individual channel, and a plurality of channels linked to the pressurization chambers 10 is bound together and then linked to the second shared channels 22. Specifically, the individual channels 14*a* to each of which only one pressurization chamber 10 is linked are bound into the connection channels 14*b* and then linked to the second shared channels 22. In other expressions, a plurality of individual channels 14*a* is linked to one connection channel 14*b*. That is, a plurality of individual channels 14*a* is connected to an end at the upstream of each connection channel 14*b* constituting the second relay channel 14, and the second shared channel 22 is connected to an end at the downstream of the connection channel 14*b*. Consequently, it is possible to reduce a space required for arranging the channels more than when disposing completely individual channels.

A form is assumed such that, when two or more lines of the discharge hole lines 9A (in another point of view, the pressurization chambers 10) are disposed at one side of one second shared channel 22, as with the present embodiment, the pressurization chambers 10 and the second shared channels 22 are linked to each other by completely individual second relay channels with the second relay channels extending by the shortest distance. In this form, the second relay channels linked to the pressurization chambers 10 farther from the second shared channels 22 are longer than the second relay channels linked to the pressurization chambers 10 nearer to the second shared channels 22. As a result, the channel characteristics thereof differ from each other. When, as with the present embodiment, portions of the second relay channels 14 connected to two pressurization chambers 10 that differ from each other in terms of distance from the second shared channels 22 are bound together, it is possible to lengthen the second relay channels linked to the pressurization chambers 10 near the second shared channels 22 and to efficiently dispose the long channels.

The longer the connection channels 14*b* than the individual channels 14*a*, that is, the higher the ratio of the connection channels 14*b* occupying the second relay channels 14, the more the space efficiency can be improved.

A portion of a pressure with which discharging has been performed is transmitted from a plurality of the pressurization chambers 10 to the fluid in the second shared channels 22, and complex pressure vibrations are generated. A portion of the pressure vibrations is transmitted to the pressurization chambers 10 and may influence subsequent discharging. When the pressures from two pressurization chambers 10 are combined in the connection channels 14*b* before being transmitted to the second shared channels 22 and then are caused to be transmitted thereto, it is possible to reduce the complexity of the pressure vibrations in the second shared channels 22 and to reduce the influence on subsequent discharging. If a completely circular columnar channel is filled with a Newtonian fluid, pressure waves are transmitted independently from each other. However, with an actual channel shape and a real fluid, pressures influence each other. The connection channel 14*b* is preferably longer than the individual channel 14*a* so that combining of pressures is accelerated.

The discharging pressure generated in one pressurization chamber 10 passes through the individual channel 14*a* linked to the pressurization chamber 10 and then is transmitted to another pressurization chamber 10 through the individual channel 14*a* linked to the other pressurization chamber 10. To reduce a change in discharging characteristics caused by such pressure propagation, it is preferable that the channel resistance of the individual channels 14*a* be larger than the channel resistance of the connection channels 14*b*. As a result, pressure propagation such as that described above can be suppressed from easily occurring.

The space efficiency can be improved by binding a plurality of the individual channels 14*a* into the connection channels 14*b* and then linking the connection channels 14*b* to the second shared channels 22. Consequently, the second relay channels 14 linked to the discharge holes 8 disposed in a first gap region between two second shared channels 22 can be disposed within the first gap region in plan view.

The space efficiency can be improved by binding a plurality of the individual channels 14*a* into the connection channels 14*b* and then linking the connection channels 14*b* to the second shared channels 22. Consequently, the second relay channels 14 linked to the discharge holes 8 disposed in a second gap region between two first shared channels 20 can be disposed within the second gap region in plan view.

The second relay channels 14 are preferably linked near the discharge holes 8 of the partial channels 10*b* to suppress the fluid near the discharge holes 8 from remaining. Thus, the second relay channels 14 are preferably disposed nearer than the first shared channels 20 to the discharge hole surface 4-2. Consequently, it becomes difficult for the second relay channels 14 to use a space more than the same plane as the first shared channels 20. Even in such a state, the space efficiency can be improved by binding a plurality of individual channels 14*a* into the connection channels 14*b* and then linking the connection channels 14*b* to the second shared channels 22, which enables the second shared channels 22 and the second relay channels 14 to be disposed nearer than the first shared channels 20 to the discharge hole surface 4-2. In addition, the entirety, excluding both end, of the second shared channels 22 and the entirety of the second relay channels 14 can be disposed nearer than the first shared channels 20 to the discharge hole surface 4-2.

Each individual channel 14*a* includes a first part 14*aa* directly linked to the pressurization chamber 10, and a second part 14*ab* linking the first part 14*aa* and the connection channel 14*b* to each other. The first part 14*aa* is constituted as a result of a hole or a groove in one plate 4*n* being closed by the flat surface parts of the other plates 4*m* and 4*o*. The second part 14*ab* is constituted as a result of a hole or a groove in the plate 4*m*, which is different from the plate 4*n* that has the hole or the groove constituting the first part 14*aa*, being closed by the flat surface parts of the other plates 4*l* and 4*n*.

The channel resistance per unit length of the first part 14*aa* is larger than the channel resistance per unit length of the second part 14*ab*. Consequently, the pressure from the pressurization chambers 10 is suppressed from being easily transmitted to the second relay channels 14, and the pressure vibrations in the pressurization chambers 10 are suppressed from becoming complex. In the present embodiment, due to the first parts 14*aa* being directly connected to the pressurization chambers 10, reflection of pressure waves occurs at mainly the connection parts. As a result, the pressure vibrations in the pressurization chambers 10 become relatively simple, and subsequent discharging can be relatively easily performed in accordance with the pressure vibrations. If a part in which channel resistance is high is present in an intermediate portion of the individual channel 14*a*, refection of large pressure waves occurs in two locations of the connection part between the pressurization chamber 10 and the individual channel 14*a* and the part in which channel resistance is high. Thus, the pressure vibrations in the pressurization chamber 10 easily become complex and make it difficult to perform subsequent discharging in consideration of the pressure vibrations. Consequently, discharging characteristics are caused to easily change due to pressure vibrations.

The plate 4*m* is thicker than the plate 4*n*. With such a configuration, required channel characteristics (channel resistance and the like) can be satisfied by the first part 14*aa*. Meanwhile, the individual channels 14*a* can be linked to each other by the second part 14*ab* whose sectional area is larger than the sectional area of the first part 14*aa* and whose influence of the channel characteristics occupying the individual channel 14*a* is small.

When a plate having a hole or a groove that serves as the second shared channel 22 is employed as the plate 4*m*, the number of required plates can be reduced. The AL of each pressurization chamber 10 can be shortened by making the plate 4*n* be thinner than the plate 4*m*, which makes it possible to drive the head 2 in a short period.

At a connection location where two individual channels 14*a* and the connection channel 14*b* are connected to each other, an angle formed by the individual channels 14*a* is smaller than an angle formed by the individual channel 14*a* and the connection channel 14*b*. The angle formed by the individual channels 14*a* is about 80 degrees. The angle formed by the individual channel 14*a* and the connection channel 14*b* is substantially 90 degrees due to the connection channel 14*b* being linked so as to extend upward with respect to the individual channel 14*a*. Therefore, the magnitude relationship between these angles is as described above.

By establishing such a magnitude relationship of the angles, the pressure transmitted from one individual channel 14*a* is more easily transmitted to the connection channel 14*b* than the other individual channels 14*a*. It is thus possible to reduce pressure propagation generated between the pressurization chambers 10 linked via the second relay channel 14.

In the present embodiment, the two individual channels 14*a* both satisfy the conditions described above. However, even when only one individual channel 14*a* satisfies the conditions, the effects described above are provided regarding the one individual channel 14*a*. When all of the individual channels 14*a* satisfy the conditions, the effects described above are provided regarding all of the individual channels 14*a*.

[Bypass Channel]

As illustrated in FIG. 6, the first channel member 4 includes a bypass channel 16 that links the first shared channel 20 and the second shared channel 22 to each other. As already described, the pressurization chambers 10 also link the first shared channel 20 and the second shared channel 22 to each other. The bypass channel 16 is linked to the first shared channel 20 and the second shared channel 22 to be in parallel with the pressurization chambers 10. As understood also from the figure, parallel here is parallel relating to connection (parallel relating to serial connection/parallel connection) and is not parallel in a spatial positional relationship (a state of extending parallel in the same direction). The bypass mentioned here does not necessarily mean circumvention (detour) and includes short-cut. That is, a path from the first shared channel 20 via the bypass channel 16 to the second shared channel 22 may be shorter than a path from the first shared channel 20 via the pressurization chambers 10 to the second shared channel 22.

In more detail, the bypass channel 16 has one end connected to the first shared channel 20 and the other end connected to the second relay channel 14. That is, the other end of the bypass channel 16 is linked to the second shared channel 22 via the connection channel 14*b*. The bypass channel 16 can be regarded to share (the bypass channel 16 includes the connection channel 14*b*) the connection channel 14*b* with the second relay channel 14. In the description of the present embodiment, however, the bypass channel 16 is expressed based on that the bypass channel 16 does not include the connection channel 14*b*.

Hereinafter, a combination of various channels relating to, of a plurality of the first shared channels 20, one first shared channel 20 is sometimes referred to as a unit channel 18. The unit channel 18 includes one first shared channel 20 and one second shared channel 22 and includes a plurality of the first relay channels 12, a plurality of the pressurization chambers 10, a plurality of the second relay channels 14, and a plurality of the bypass channels 16 that link the two shared channels to each other. The unit channel 18 further includes a plurality of the discharge holes 8 linked to the plurality of pressurization chambers 10 included in the unit channel 18.

(Connection Location of Bypass Channel in Channel Direction of Shared Channels)

Figure 7:
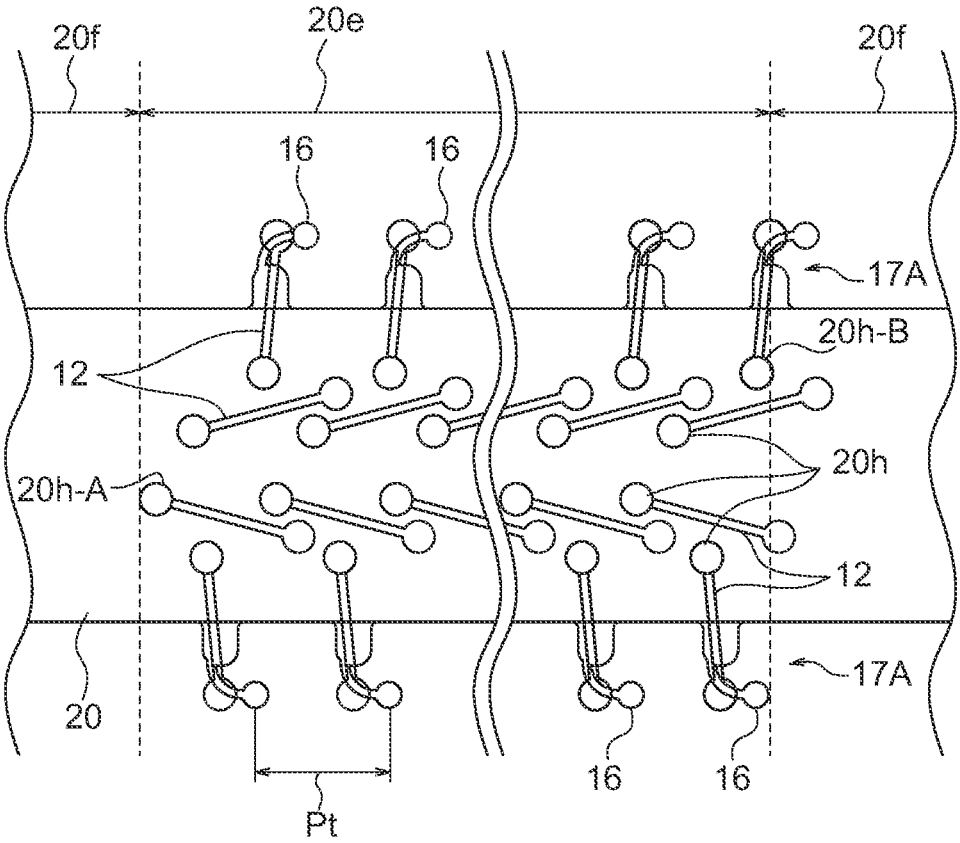
FIG. 7 is a partially enlarged plan view of a first shared channel and bypass channels.
Figure 8:
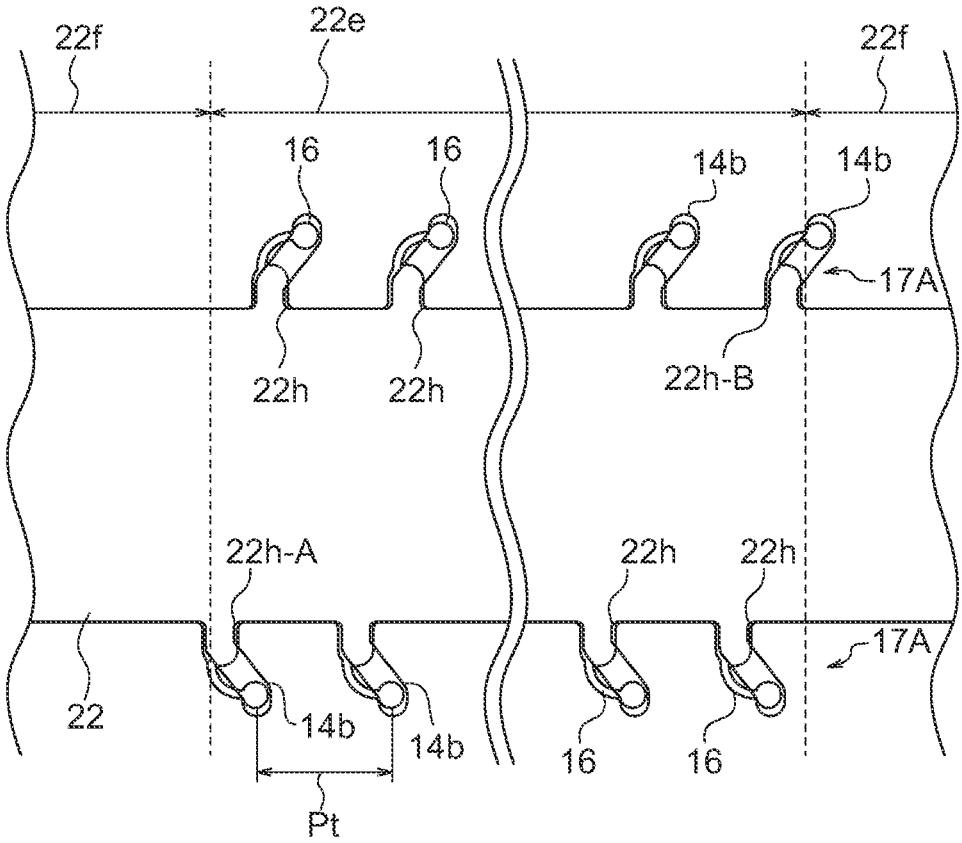
FIG. 8 is a partially enlarged plan view of a second shared channel and bypass channels.

FIG. 7 and FIG. 8 are plan views for describing the connection location of the bypass channels 16 in the channel direction of the shared channels. Specifically, regarding one unit channel 18, FIG. 7 illustrates the first shared channel 20, a plurality of the first relay channels 12, and a plurality of the bypass channels 16. Regarding one unit channel 18, FIG. 8 illustrates the second shared channel 22, a plurality of the second relay channels 14 (in more detail, the connection channels 14*b*), and a plurality of the bypass channels 16.

Here, one unit channel 18 will be described. The other unit channels 18 may be considered the same.

As described with reference to FIG. 3 and other figures and as illustrated in FIG. 7, the first shared channel 20 includes a first connection region 20*e* (directly) connected to a plurality of the first relay channels 12 and a first non-connection region 20*f* not (directly) connected to the plurality of first relay channels 12. Similarly, as described with reference to FIG. 3 and other figures and as illustrated in FIG. 8, the second shared channel 22 includes a second connection region 22*e* (directly) connected to a plurality of the second relay channels 14 and a second non-connection region 22*f* not (directly) connected to the plurality of second relay channels 14. At least some (all in the illustrated example) of the bypass channels 16 connect the first connection region 20*e* and the second connection region 22*e* (exactly, the connection channel 14*b* connected to the second connection region 22*e*; the same applies to the followings.) to each other. The plurality of bypass channels 16 may include the bypass channels 16 connected to the first non-connection region 20*f* and/or the second non-connection region 22*f*.

The ranges of the first connection region 20*e* and the second connection region 22*e* may be defined, as appropriate. For example, specifically, it is defined as follows.

First, confirmatively describing, the first connection region 20*e* and the first non-connection region 20*f* are regions demarcated in the first shared channel 20 in the channel direction thereof (in other words, in the longitudinal direction or a direction in which an ink flows; the same applies to the second shared channel 22 and the like). The second connection region 22*e* and the second non-connection region 22*f* are regions demarcated in the second shared channel 22 in the channel direction thereof.

The first shared channel 20 has a plurality of first openings 20*h* individually linked to the plurality of first relay channels 12. The plurality of first openings 20*h* are distributed in the channel direction of the first shared channel 20. In more detail, the plurality of first openings 20*h* is disposed side by side in one or more rows (four rows in the illustrated example) in the channel direction. In such a configuration, the first opening 20*h* located nearest to one side (left side in the figure) in the channel direction is referred to as a first opening 20*h*-A. The first opening 20*h* located nearest to the other side (right side in the figure) in the channel direction is referred to as a first opening 20*h*-B. A region from the position of the first opening 20*h*-A to the position of the first opening 20*h*-B may be regarded as the first connection region 20*e*. The position of the first opening 20*h*-A may be based on, for example, of the first opening 20*h*-A, an edge portion nearest to the one side (left side in the figure). Similarly, the position of the first opening 20*h*-B may be based on, for example, of the first opening 20*h*-B, an edge portion nearest to the other side (right side in the figure).

The same applies to the second connection region 22*e*. Specifically, the second shared channel 22 has a plurality of second openings 22*h* individually linked to the plurality of the second relay channels 14. The plurality of second openings 22*h* is distributed in the channel direction of the second shared channel 22. In more detail, the plurality of second openings 22*h* is disposed side by side in one or more rows (two rows in the illustrated example) in the channel direction. In such a configuration, the second opening 22*h* located nearest to one side (left side in the figure) in the channel direction is referred to as a second opening 22*h*-A. The second opening 22*h* located nearest to the other side (right side in the figure) in the channel direction is referred to as a second opening 22*h*-B. A region from the position of the second opening 22*h*-A to the position of the second opening 22*h*-B may be regarded as the second connection region 22*e*. For example, the position of the second opening 22*h*-A may be based on, of the second opening 22*h*-A, an edge portion nearest to the one side (left side in the figure). Similarly, for example, the position of the second opening 22*h*-B may be based on, of the second opening 22*h*-B, an edge portion nearest to the other side (right side in the figure).

Conversely, both outer sides from the first openings 20*h*-A and 20*h*-B may be regarded as the first non-connection region 20*f*. Similarly, both outer sides from the second openings 22*h*-A and 22*h*-B may be regarded as the second non-connection region 22*f*.

Differently from the present embodiment, it is possible to dispose the first opening 20*h*-A and/or the first opening 20*h*-B at an end of the first shared channel 20 and eventually not to dispose the first non-connection region 20*f* at both sides and/or one side of the first connection region 20*e*. From another point of view, the first connection region 20*e* may be a portion of the first shared channel 20, as with the embodiment, or may be the entirety of the first shared channel, differently from the embodiment. When the first non-connection region 20*f* is disposed, the length (in the channel direction) of the first non-connection region 20*f* may be longer, as with the embodiment, than a distance (or a pitch Pt) between the first openings 20*h* adjacent to each other in each row or may be shorter, differently from the embodiment, than a distance between the first openings 20*h* adjacent to each other in each row. The first non-connection region 20*f* has been described, and the same applies to the second non-connection region 22*f*.

In the present embodiment, the first shared channel 20 has both ends. Accordingly, the first openings 20*h*-A and 20*h*-B may be regarded to be located nearest, among the plurality of first openings 20*h*, to both ends in the channel direction of the first shared channel 20, as described above. Although not particularly illustrated, the first shared channel may have an annular shape. Even in such a situation, a first opening nearest to an end may be specified by regarding, as an end of the first shared channel, the position of openings corresponding to the openings 20*b* that supply an ink to the first shared channel 20. Regarding the second shared channel 22, similarly, a second opening nearest to an end may be specified by regarding, as an end of the second shared channel, the position of openings corresponding to the openings 22*b*.

In an annular first shared channel and the like, the first non-connection region may be disposed in a location away from the openings corresponding to the openings 20*b*. For example, when the first shared channel extends in a U-shape, the first non-connection region may be disposed at the returning part and the periphery thereof. In such a situation, for example, specifying the first openings (20*h*-A/20*h*-B) defining the ends of the first connection region and determining presence/absence of the first non-connection region may be performed reasonably.

For example, the first connection region normally has a linear shape parallel to the pressurization chamber lines (discharge hole lines). Accordingly, a first opening nearest to the returning part may be regarded as a first opening located at an end of the first connection region. That is, even if there is a conventional art in which a bypass channel that connects a first shared channel and a second shared channel to each other is disposed at a returning part, the bypass channel does not correspond to the bypass channel 16 in the present embodiment.

In addition, for example, the plurality of first openings is basically arranged with a constant pitch (in another point of view, with a constant gap). For example, focusing on the first openings 20*h* in one row in the embodiment, the pitch in the channel direction is constant. In such a situation, a region from an end to an end of a plurality of the first openings relating to the constant pitch may be regarded as the first connection region. In other words, when a pitch larger than the constant pitch is present, a region that constitutes the relatively large pitch and that is between two first openings adjacent to each other in the channel direction may be determined as the first non-connection region. At a part where the first shared channel (in the channel direction) is not liner, the pitch may be measured, for example, with the length along the first shared channel (the same applies to the pitch of the second openings, the pitch of the bypass channels 16, and the like).

In addition, for example, when the pitch of the plurality of first openings is not constant, the change thereof has a periodic characteristic. For example, when the first openings 20*h* in four rows in the embodiment are collectively considered, the pitch in the channel direction of the first shared channel may have a periodic characteristic, or the change of the pitch of the first openings 20*h* in one row may have a periodic characteristic. In such a situation, when a pitch is larger than the other pitches in a very small number of portions (for example, one to four locations in the channel direction) and the periodic characteristic is thereby disturbed, a region that constitutes the relatively large pitch and that is between two first openings adjacent to each other in the channel direction may be determined as the first non-connection region.

In addition, for example, even if no periodic characteristic is found in the change of the pitch, when a pitch is extremely larger (for example, five times or more) than the other pitches in a very small number of portions (for example, one to four locations in the channel direction), a region that constitutes the extremely large pitch and that is between two first openings adjacent to each other in the channel direction may be determined as the non-connection region.

It has been described that specifying the ends of the first connection region and determining presence/absence of the first non-connection region may be performed reasonably. Specifying ends of the second connection region and determining presence/absence of the second non-connection region may be also performed similarly.

(Relationship Among a Plurality of Bypass Channels)

A plurality of the bypass channels 16 is generally arranged, for example, at both sides of the first shared channel 20 and the second shared channel 22 to extend in the channel direction of these shared channels and constitutes a total of two lines of channel lines 17A. In each channel line 17A, the shapes of the plurality of bypass channels 16 are identical to each other. Among the channel lines 17A connected to the same shared channel, the shapes of the bypass channels 16 are, for example, shapes (the illustrated example) that are line symmetrical with the center line of the shared channel being the axis of symmetry in plan view or shapes that are 180° rotation symmetrical in plan view.

In each channel line 17A, the bypass channels 16 are, for example, disposed side by side with a constant pitch. In addition, for example, the size of the pitch of the bypass channels 16 is the same between two channel lines 17A at both sides of the shared channel. Between two channel lines 17A, the positions of the bypass channels 16 may be shifted from each other by an appropriate distance (a substantially half pitch in the illustrated example) or may be in coincident with each other. The size of the pitch of the plurality of bypass channels 16 in one channel line 17A is, for example, equal to the size of the pitch of the pressurization chambers 10 in one pressurization chamber line 11A. In the present embodiment, two lines of the pressurization chamber lines 11A and one line of the channel line 17A are disposed at one side of the shared channel. The bypass channels 16 are thus disposed one each per two pressurization chambers 10.

When a feature in which a plurality of the bypass channels 16 is disposed side by side with a constant pitch is described in a superordinate concept, the plurality of bypass channels 16 is disposed side by side (disposed side by side in accordance with a constant rule) in each channel line 17A regularly along the shared channels. Regularity in the arrangement of the plurality of bypass channels 16 is the same among a plurality of channel lines 17A connected to the same shared channels. Even when regularity is the same among the plurality of channel lines 17A, the positions (phase of the period) of the bypass channels 16 may be shifted from each other (shifted by a half pitch in the illustrated example) among the plurality of channel lines 17A. The channel lines 17A have been focused to describe that a plurality of the bypass channels 16 is regularly disposed side by side. In the illustrated example, the plurality of bypass channels 16 can be also regarded to be disposed side by side regularly in the channel direction of the shared channels even when the plurality (two here) of channel lines 17A connected to the same shared channels is collectively considered.

When disposed side by side regularly, although not particularly illustrated, the plurality of bypass channels 16 may be disposed side by side, for example, in the following form in addition to a form of being disposed side by side with a constant pitch as described above.

The plurality of bypass channels 16 may be disposed side by side in a form in which the pitch changes periodically. Specifically, for example, bypass channels of two types whose shapes differ from each other may be arranged at one side of the shared channels alternately in one row generally, and two types of pitches may be present alternately. In such a situation, it may be regarded that two types of channel lines are disposed and the pitch is constant in one type of the channel line. Regarding the bypass channels of the two types whose shapes differ from each other, in addition to shapes that are line symmetrical to each other with respect to the axis of symmetry orthogonal to the shared channels in plan view, shapes that are not even symmetrical to each other are presented as examples.

In addition, for example, two lines of pressurization chamber lines may be present at one side of the shared channels, consequently, two types of relay channels may be arranged with two types of pitches at one side of the shared channels, and bypass channels having the same shape may be disposed in a location in accordance with the two types of the pitches. Even in such a situation, it is also possible to regard that two types of channel lines are disposed and the pitch is constant in one type of the channel line.

The pitch may be regarded, for example, based on the geometrical centers of gravity of the bypass channels 16, as a distance between the centers of gravity. When the shapes of the plurality of bypass channels 16 are identical to each other, the pitch may be measured based on specific parts (for example, the first openings 20*h* or the second openings 22*h*) of the bypass channels 16.

(Specific Connection Location of Each Bypass Channel)

Ends of the bypass channels 16 near the first shared channels 20 may be connected to any locations nearer to the first shared channels 20 than the pressurization chambers 10 and, for example, may be connected to locations nearer to the first shared channels 20 than, of the first relay channels 12, parts (contracted parts) the sectional area of each of which is narrowest. In the illustrated example, the bypass channel 16 is directly connected to the first shared channel 20.

When the bypass channels 16 are connected to the first shared channels 20, each bypass channel 16 may be connected to any of the upper surface, the side surface, and the lower surface of the first shared channels 20, may be connected to a combination of two or more of these surfaces, and may be connected to any locations in each surface. In the illustrated example, the bypass channel 16 is connected to the side surface of the first shared channel 20 and, specifically, opens at an upper portion of the side surface.

In the channel direction of the first shared channels 20, the connection location of the bypass channels 16 with respect to the first shared channels 20 and the relative position thereof with respect to the pressurization chambers 10 and the like may be also set, as appropriate. For example, at one side of the sides of the first shared channels 20, the connection location of each bypass channel 16 may overlap the positions of the first openings 20*h* relating to any of the pressurization chamber lines 11A in the channel direction of the first shared channels 20 (illustrated example) or may not overlap the positions of the first openings 20*h* in any of the pressurization chamber lines 11A.

Ends of the bypass channels 16 near the second shared channels 22 may be connected to any locations (including the second shared channels 22) nearer to the second shared channels than the pressurization chambers 10. In the illustrated example, the bypass channel 16 is connected to the second relay channel 14 and, specifically, is connected to the connection channel 14*b* of the second relay channel 14. More specifically, the bypass channel 16 is connected to, of the connection channel 14*b*, a portion nearer to the individual channel 14*a* (at the upstream of the connection channel 14*b*) than the center thereof. Further specifically, the bypass channel 16 is connected to, of the connection channel 14*b*, a connection location with respect to the individual channel 14*a*. The connection location of the connection channel 14*b* with respect to the individual channel 14*a* is located at an end at the upstream of the connection channel 14*b*. Consequently, it is possible to ensure the length of an intermediate part 16*b* (described later) of the bypass channel 16 and ensure a desired channel resistance in the intermediate part 16*b*. From another point of view, the bypass channel 16 is connected to, of the second relay channel 14, a portion nearer to the second shared channel 22 than the first part 14*aa* (a part whose sectional area is narrowest). Thus, the lengths of the individual channels 14*a* connected to respective discharge holes 8 are preferably identical to each other. The connection location of each connection channel 14*b* with respect to the individual channels 14*a* is a location where a plurality of the individual channels 14*a* (two individual channels 14*a* in the figure) merge together. Distances from the connection location to the discharge holes 8 each connected to a respective one of the plurality of individual channels 14*a* are preferably equal to each other. Each bypass channel 16 is preferably connected to the connection location whose distances from the discharge holes 8 are the same. Consequently, while suppressing differences in the discharging characteristics (variations in the discharging characteristics) among the plurality of discharge holes 8, it is possible to replenish an ink to the second shared channels 22 through the bypass channels 16.

When each bypass channel 16 is connected to, of the connection channel 14*b*, the connection location with respect to the individual channel 14*a*, for example, it is sufficient that at least a portion of an opening between the connection channel 14*b* and the individual channel 14*a* and at least a portion of an opening connecting the connection channel 14*b* and the bypass channel 16 to each other overlap each other in the channel direction of the connection channel 14*b*. In the illustrated example, in the connection location (the end at the upstream of the connection channel 14*b*) between the connection channel 14*b* and the individual channel 14*a*, these two channels are superposed on each other vertically, and the bypass channel 16 is further superposed thereon. In plan view, one of the opening connecting the connection channel 14*b* and the individual channel 14*a* to each other and the opening connecting the connection channel 14*b* and the bypass channel 16 to each other is present within the other or these openings are in coincident with each other. Accordingly, in the channel direction of the connection channel 14*b*, the entirety of one of the two openings overlaps a portion of the other, or the entirety thereof overlap each other.

(Shape of Bypass Channel)

The shape of each bypass channel 16 may be set, as appropriate. For example, the entirety of each bypass channel 16 may be linear, or a portion or the entirety thereof includes a bent or curved part. The sectional area of each bypass channel 16 may be constant, or the sectional area may change.

In the illustrated example, the bypass channel 16 includes a first shared side part 16*a* that includes an end near the first shared channel 20, a second shared side part 16*c* that includes an end near the second shared channel 22, and the intermediate part 16*b* that connects the two shared side parts to each other. The intermediate part 16*b* is a part (a part whose sectional area is smallest in the bypass channel 16) whose sectional area is smaller than those of the first shared side part 16*a* and the second shared side part 16*c* and, from another point of view, a part whose channel resistance per unit length is larger than those of the first shared side part 16*a* and the second shared side part 16*c*.

The first shared side part 16*a* is constituted by, for example, holes or grooves in all (in the illustrated example) or some of the plates 4*f* to 4*i* having holes or grooves that serve as the first shared channel 20. The first shared side part 16*a* includes, for example, a part extending from the first shared channel 20 toward the side thereof and a part extending downward from the tip thereof. For example, in plan view, at least a portion of the first shared side part 16*a* is superposed on at least a portion of the connection channel 14*b*. The sectional area of the first shared side part 16*a* may be set, as appropriate. For example, the sectional area of the narrowest part of the first shared side part 16*a* is ¼ times or more and four times or less the sectional area of the narrowest part of the partial channel 10*b* or the connection channel 14*b*.

The intermediate part 16*b* is constituted by, for example, a hole or a groove in either (4*j* in the illustrated example) of the plates between the plates 4*f* to 4*i* having holes or grooves that serve as the first shared channel 20 and plates 4*l* to 4*m* having holes or grooves that serve as the second shared channel 22. From another point of view, the intermediate part 16*b* is constituted by a hole or a groove in one plate. The intermediate part 16*b*, for example, extends parallel to the discharge hole surface 4-2 from the first shared side part 16*a* and curves in plan view. For example, in plan view, at least a portion of the first shared side part 16*a* is superposed on at least a portion of the connection channel 14*b*. The sectional area of the intermediate part 16*b* may be set, as appropriate, and is, for example, ¼ times or more and four times or less the sectional area of the narrowest part of the first relay channel 12 or the sectional area of the narrowest part (first part 14*aa*) of the second relay channel 14. The intermediate part 16*b* is preferably disposed in the layer between the first shared channel 20 and the second shared channel 22. Specifically, the intermediate part 16*b* is preferably disposed in the plate 4*j*. The plate 4*j* is located on the lower surface of the first shared channel 20 and forms the damper 28A while forming the damper chamber 29A at a side of the damper 28A opposite to the side thereof facing the first shared channel 20. The plate 4*j* is a relatively thin plate. Thus, it is possible by disposing the intermediate part 16*b* in the thin plate to easily form a part (a part whose sectional area is smallest in the bypass channel 16) whose sectional area is smaller than those of the first shared side part 16*a* and the second shared side part 16*c* in the bypass channel 16.

The second shared side part 16*c* is constituted by, for example, a hole or a groove in a plate (4*k* in the illustrated figure) between the plate 4*j* having a hole or a groove that serves as the intermediate part 16*b* and the plate 4*l* having a hole or a groove that serves as the connection channel 14*b*. The second shared side part 16*c*, for example, extends downward from the intermediate part 16*b* and is connected to the connection channel 14*b*. The sectional area of the second shared side part 16*c* may be set, as appropriate. For example, the sectional area of the narrowest part of the second shared side part 16*c* is ¼ times or more and four times or less the sectional area of the narrowest part of the partial channel 10*b* or the connection channel 14*b*.

(Channel Resistance of Bypass Channel)

The channel resistance of the bypass channels 16 may be set, as appropriate. For example, the channel resistance of the bypass channels 16 may be set such that the channel resistance from the first shared channel 20 to the second shared channel 22 via one bypass channel 16 is ¼ times or more and four times or less or ½ times or more and two times or less the channel resistance from the first shared channel 20 to the second shared channel 22 via two pressurization chambers 10. Confirmatively describing, the former channel resistance includes the channel resistance of one connection channel 14*b*. The latter channel resistance includes the channel resistance of two first relay channels 12 and the channel resistance of two relay channels 14 (two individual channels 14*a* and one connection channel 14*b*).

As described above, in the present embodiment, each fluid discharge head 2 includes the first channel member 4 and the plurality of pressurization portions (displacement elements 50). The first channel member 4 includes a plurality of the discharge holes 8, a plurality of the pressurization chambers 10 individually linked to the plurality of discharge holes 8, the first shared channel 20 linked to the plurality of pressurization chambers 10, and the second shared channel 22 linked to the plurality of pressurization chambers 10. The plurality of displacement elements 50 individually pressurizes the plurality of pressurization chambers 10. The first shared channel 20 opens at a plurality of the first openings 20*h* linked to the plurality of pressurization chambers 10. The first shared channel 20 includes the first connection region 20*e*, which is a range of distribution of the plurality of first openings 20*h* in the channel direction of the first shared channel 20. The second shared channel 22 opens at a plurality of second openings 22*h* linked to the plurality of pressurization chambers 10. The second shared channel 22 includes the second connection region 22*e*, which is a range of distribution of the plurality of second openings 22*h* in the channel direction of the second shared channel 22. The first channel member 4 further includes the bypass channel 16 linked to the first connection region 20*e* and the second connection region 22*e* to be in parallel with the plurality of pressurization chambers 10.

Accordingly, for example, it is possible to suppress a change (decrease) in the discharging characteristics. Specifically, for example, there is a possibility of a large amount of an ink being discharged through the discharge holes 8 depending on the content of an image. In such a situation, the ink that is collected from the pressurization chambers 10 into the second shared channel 22 via the second relay channel 14 decreases compared with when only a small amount an ink is discharged. There is also a possibility of occurrence of a backflow from the second relay channel 14 toward the pressurization chambers 10. As a result, the pressure applied to the ink in the discharge holes 8 decreases, and eventually, the discharge amount of the ink decreases compared with an estimated discharge amount. That is, the discharging characteristics change. However, due to the bypass channel 16 connecting the first shared channel 20 and the second shared channel 22 to each other by a path that differs from the pressurization chambers 10, it is possible to compensate a shortage amount of the ink in the second shared channel 22. The connection location of the bypass channel 16 with respect to the first shared channel 20 and the second shared channel 22 is within the first connection region 20*e* and the second connection region 22*e* in which the pressurization chambers 10 are connected to the first shared channel 20 and the second shared channel 22. Thus, the connection location is near the discharge holes 8, compared with when the bypass channel is disposed outside thereof. It is thus possible in an early state to compensate ink shortage that influences the pressure applied to the discharge holes 8. As a result, the change in the discharging characteristics is suppressed. Eventually, image quality is improved.

In the present embodiment, the first channel member 4 includes a plurality of bypass channels 16 arranged side by side regularly in the channel direction of the first shared channel 20.

In such a situation, for example, the plurality of bypass channels 16 is disposed in accordance with a plurality of the first openings 20*h* and a plurality of the second openings 22*h* (in another point of view, a plurality of the pressurization chambers 10 and a plurality of the discharge holes 8) distributed in the channel direction of the first shared channel 20 and the second shared channel 22. Accordingly, regarding the plurality of discharge holes 8, it is possible to more uniformly replenish an ink to the second shared channel 22. As a result, for example, a difference in the discharging characteristics (a variation in the discharging characteristics) among the plurality of discharge holes 8 is reduced. Eventually, image quality is improved.

In the present embodiment, the first channel member 4 includes a plurality of the second relay channels 14 linking the plurality of pressurization chambers 10 and the plurality of second openings 22*h* to each other. The bypass channel 16 is connected to at least one second relay channel 14 of the plurality of second relay channels 14 and linked to the second connection region 22*e* via the at least one second relay channel 14.

In such a situation, for example, it is possible to replenish an ink to a location near the discharge holes 8, compared with when the bypass channel 16 is directly connected to the second connection region 22*e*. As a result, for example, it is possible to restore the discharging characteristics in an early stage. From another point of view, a portion (a portion of the second relay channel 14) of a path from the first shared channel 20 to the second shared channel 22 via the pressurization chambers 10 is commonly used as a path from the first shared channel 20 to the second shared channel 22 via the bypass channel 16. As a result, for example, the space efficiency is improved.

In the present embodiment, the second relay channel 14 includes a plurality of the individual channels 14*a* and a plurality of the connection channels 14*b*. The plurality of individual channels 14*a* is linked to a plurality of the pressurization chambers 10. The plurality of connection channels 14*b* links two or more of the plurality of individual channels 14*a* and the second connection region 22*e* to each other. The number of the connection channels 14*b* is less than the number of the plurality of individual channels 14*a*. The bypass channel 16 is connected to at least one connection channel 14*b* of the plurality of connection channels 14*b* and linked to the second connection region 22*e* via the at least one connection channel 14*b*.

In such a situation, for example, it is possible to replenish an ink to two or more individual channels 14*a* without branching one bypass channel 16. As a result, the space efficiency is improved. For example, it is possible to restore the discharging characteristics in an early stage. From another point of view, for example, it is possible to replenish an ink to a location near the discharge holes 8, compared with when the bypass channel 16 is directly connected to the second connection region 22*e*. It is thus possible to restore the discharging characteristics in an early stage.

In the present embodiment, the first shared channel 20 (at least a portion thereof) is superposed with respect to the second shared channel 22 (at least a portion thereof) at one side (upper) in the opening direction of the discharge holes 8. The bypass channel 16 (at least a portion thereof) is superposed with respect to the second relay channel 14 (at least a portion thereof) linked to the bypass channel 16 at the one side (upper) in the opening direction. In such a situation, for example, the space efficiency is improved.

In the present embodiment, the first channel member 4 includes a plurality of pressurization chambers 10 and a plurality of the bypass channels 16 with a pitch in which the bypass channels 16 are disposed one each per a predetermined number (two in the illustrated example) of the pressurization chambers 10 in the channel direction of the first shared channel 20. The channel resistance of a path from the first shared channel 20 to the second shared channel 22 via one bypass channel 16 is ½ times or more and two times or less the channel resistance of a path from the first shared channel 20 to the second shared channel 22 via the predetermined number of the pressurization chambers 10.

In such a situation, for example, it is possible to compensate ink shortage in the second shared channel 22 in just proportion. As a result, while reducing the change in the discharging characteristics, it is possible to reduce circulation of an excess ink in the light of a purpose of circulating an ink (for example, in the light of sedimentation of pigments and adhesion of an ink).

In the present embodiment, each bypass channel 16 includes a first constituent part (first shared side part 16*a*) connected to the first shared channel 20, and a second constituent part (intermediate part 16*b*) connected to the first shared side part 16*a* and linked to the first shared channel 20 via the first shared side part 16*a*. Channel resistance per unit length of the intermediate part 16*b* is larger than channel resistance per unit length of the first shared side part 16*a*.

Accordingly, for example, it is possible to reduce a possibility of pressure waves being propagated between the first shared channel 20 and the second shared channel 22 via the bypass channels 16, compared with bypass channels (such a bypass channel may be included in the bypass channels according to the present disclosure) that have channel resistance identical as a whole to that of the bypass channels 16 having such a configuration and that are constant throughout the entire length thereof in terms of channel resistance per unit length. Meanwhile, it is possible to reduce a possibility that the pressure waves in the first shared channel 20 are absorbed at the first shared side part 16*a* due to the first shared side part 16*a* whose sectional area is relatively wide being connected to the first shared channel 20 and the pressure waves are propagated among the pressurization chambers 10. As a result, it is possible to make the discharging characteristics stable.

In the present embodiment, the first channel member 4 includes a plurality of the unit channels 18. Each unit channel 18 includes a combination of a plurality of the discharge holes 8, a plurality of the pressurization chambers 10, the first shared channel 20, the second shared channel 22, and the bypass channel 16.

In such a situation, for example, the bypass channel 16 contributes reducing a difference in the discharging characteristics (a variation in the discharging characteristics) among the plurality of unit channels 18. Specifically, when the discharge amount of an ink is increased only in a specific unit channel 18 in accordance with the content of an image, the unit channel 18 becomes short of the ink in the second shared channel 22, and the discharging characteristics are changed (degraded), compared with the other unit channels 18. The change in the discharge characteristics is, however, suppressed as a result of an ink being replenished to the second shared channel 22 through the bypass channel 16. The variation in the discharge characteristics of the plurality of unit channels 18 are then reduced.

In the present embodiment, each of the plurality of unit channels 18 includes the discharge hole line 9A in which a plurality of the discharge holes 8 are arranged. A plurality of the discharge hole lines 9A is in parallel with each other. Each discharge hole line 9A has a plurality of the discharge holes 8 in locations between a plurality of the discharge holes 8 of the other discharge hole lines 9A as viewed in an intersecting direction (second direction D2) with respect to the plurality of discharge hole lines 9A.

In such a configuration, the above-described variation in the discharging characteristics among the plurality of unit channels 18 becomes a factor of generating periodical light and shade (periodical striped pattern, a plurality of lines extending in the second direction D2) in a first direction D1 orthogonal to the second direction D2 in the print sheet P. As a result, image quality is degraded. It is however possible to reduce the periodical light and shade by disposing the bypass channel 16.

It is new knowledge obtained as a result of earnest examination by the inventor of the present application that a variation in the discharging characteristics among the unit channels 18 due to ink shortage in the second shared channel 22 (collection end) influences the periodical light and shade. The inventor of the present application has performed an experiment in which a line having a width of 25 μm is drawn with each of a head according to a comparative example not including the bypass channel 16 and a head according to an example including the bypass channel 16. As a result, as for the comparative example, a variation (a difference between the maximum width and the minimum width) of 3.5 μm to 4.0 μm is generated in the width of the line. As for the example, the variation in the width of the line is suppressed to about 2.0 μm.

The technology according to the present disclosure is not limited to the above-described embodiment and may be embodied in various forms.

The head may have only one unit channel. The shapes and the relative positions of the various types of channels in the unit channels are not limited to those in the illustrated shapes. The channels may have various shapes. For example, the first shared channel and the second shared channel may be disposed in parallel (for example parallel to each other) in an intersecting direction (planar direction) with respect to the opening direction of the discharge holes, instead of being disposed in a layered manner in the opening direction of the discharge holes.

In the present embodiment, the plurality of unit channels are arranged in the direction of the relative movement of the head and a recording medium. Each unit channel has a plurality of the discharge holes between a plurality of the discharge holes of the other unit channels as viewed in the direction of the relative movement of the head and a recording medium. However, for example, the plurality of unit channels may be arranged in an intersecting direction with respect to the relative movement of the head and a recording medium. The plurality of discharge holes may be arranged not to overlap each other in about one, two, or three unit channels as viewed in the direction of the relative movement of the head and a recording medium. From another point of view, unit channels (discharge hole lines) whose ranges do not overlap each other as viewed in the direction of the relative movement of the head and a recording medium may be present.

The discharge hole lines are not necessarily orthogonal to the direction of the relative movement of a recording medium and the head and may be inclined in the orthogonal direction. In each discharge hole line, the plurality of discharge holes may be arranged in a form in which a minute variation in a pitch and/or a minute displacement from a straight line are generated, instead of being arranged linearly with a constant pitch.

It is sufficient that at least one bypass channel is disposed. The number of the bypass channels may be smaller than the number of the pressurization chambers (the embodiment), or may be identical to or greater than the number of the pressurization chambers. From another point of view, the plurality of bypass channels may be disposed at a ratio of one each per a predetermined number of the pressurization chambers (the embodiment), may be disposed one each per one pressurization chamber, or may be disposed at a ratio of a predetermined number thereof per one pressurization chamber.

The second relay channel does not necessary share a portion (the connection channel 14*b*) with the other second relay channels. That is, the second relay channel may be completely independent for each pressurization chamber. The bypass channel may be connected to such a second relay channel that is completely independent for each pressurization chamber. Even in such a situation, a part (the second constituent part, the intermediate part 16*b*) whose channel resistance is suitably large and a part (the first constituent part, the first shared side part 16*a*) whose channel resistance is small may be included.

In the second relay channels that share a portion (the connection channel 14*b*) with each other, the shapes thereof are not limited to that presented as an example in the present embodiment. For example, in the present embodiment, in two second relay channels 14 that share the connection channel 14*b* with each other, the first parts 14*aa* extend in directions opposite to each other in a direction orthogonal to the shared channels, and the second parts 14*ab* have line symmetrical shapes and arrangements with respect to the axis of symmetry orthogonal to the shared channels. However, for example, the first parts may extend in directions opposite to each other in a direction along the shared channels, and the second parts may extend in directions opposite to each other in an intersecting direction with respect to the shared channels and merge together.

REFERENCE SIGNS LIST

1 color inkjet printer
2 fluid discharge head
2*a* head body
4 (first) channel member
4*a* to *o* plate
4-1 pressurization chamber surface
4-2 discharge hole surface
6 second channel member
6*a* through hole (of second channel member)
8 discharge hole
9A discharge hole line
10 pressurization chamber
10*a* pressurization chamber body
10*b* partial channel
11A pressurization chamber line
12 first relay channel
14 second relay channel
14*a* individual channel
14*aa* first part (of individual channel)
14*ab* second part (of individual channel)
14*b* connection channel
16 bypass channel
16*a* first shared side part
16*b* intermediate part
16*c* second shared side part
17A channel line
18 unit channel
20 first shared channel
20*a* first shared channel body
20*b* opening (of first shared channel)
20*e* first connection region
20*f* first non-connection region
20*h*, 20*h*-A, 20*h*-B first opening
22 second shared channel
22*a* second shared channel body
22*b* opening (of second shared channel)
22*e* second connection region
22*f* second non-connection region
22*h*, 22*h*-A, 22*h*-B second opening
24 first integrated channel
24*a* first integrated channel body
24*b* opening (of first integrated channel)
26 second integrated channel
26*a* second integrated channel body
26*b* opening (of second integrated channel)
28A, B damper
29A, B damper chamber
40 piezoelectric actuator substrate
40*a* piezoelectric ceramic layer

40*b* piezoelectric ceramic layer (vibration plate)
42 shared electrode
44 individual electrode
44*a* individual electrode body
44*b* extraction electrode
46 connection electrode
50 displacement element (pressurization portion)
70 head mounting frame
72 head group
80A feed roller
80B collection roller
82A guide roller
82B transport roller
88 control portion
D1 first direction
D2 second direction
D3 third direction
D4 fourth direction
P print sheet

The invention claimed is:

1. A fluid discharge head comprising:
a channel member comprising
a plurality of discharge holes,
a plurality of pressurization chambers individually linked to the plurality of discharge holes,
a first shared channel linked to the plurality of pressurization chambers, and
a second shared channel linked to the plurality of pressurizing chambers; and
a plurality of pressurization portions that individually pressurizes the plurality of pressurization chambers,
wherein the first shared channel opens at a plurality of first openings linked to the plurality of pressurization chambers, and the first shared channel comprises a first connection region that is a range of distribution of the plurality of first openings in a channel direction of the first shared channel,
wherein the second shared channel opens at a plurality of second openings linked to the plurality of pressurization chambers, and the second shared channel comprises a second connection region that is a range of distribution of the plurality of second openings in a channel direction of the second shared channel,
wherein the channel member further comprises
a bypass channel linked to the first connection region and the second connection region that is in parallel with the plurality of pressurization chambers, and
wherein each of the plurality of pressurization chambers comprises
a pressurization chamber body facing the pressurization portion, and
a partial channel links the pressurization chamber body to the discharge hole, the partial channel being opened at a part of a bottom surface of the pressurization chamber body, the bottom surface being at an opposite side of the pressurization portion.

2. The fluid discharge head according to claim 1,
wherein the bypass channel comprises a plurality of bypass channels, and
wherein the channel member comprises
the plurality of bypass channels disposed side by side regularly in the channel direction of the first shared channel.

3. The fluid discharge head according to claim 1,
wherein the channel member comprises
a plurality of relay channels linking the plurality of pressurization chambers and the plurality of second openings to each other, and
wherein the bypass channel is connected to at least one relay channel of the plurality of relay channels and is linked to the second connection region via the at least one relay channel.

4. The fluid discharge head according to claim 3,
wherein the first shared channel is superposed with respect to the second shared channel at one side in an opening direction of the plurality of discharge holes, and
wherein the bypass channel is superposed with respect to the at least one relay channel linked to the bypass channel at the one side in the opening direction.

5. The fluid discharge head according to claim 3, wherein the channel member comprises
a discharge hole surface at which the plurality of discharge holes open, and
a pressurization chamber surface which is opposite to the discharge hole surface and on which the plurality of pressurization portions are located, and
the first shared channel and the second shared channel are located between the discharge hole surface and pressurization chamber surface.

6. The fluid discharge head according to claim 3, wherein the bypass channel is directly connected to the first connection region.

7. The fluid discharge head according to claim 1,
wherein the bypass channel comprises
a first constituent part connected to the first connection region, and
a second constituent part connected to the first constituent part and linked to the first connection region via the first constituent part, and
wherein channel resistance per unit length of the second constituent part is larger than channel resistance per unit length of the first constituent part.

8. The fluid discharge head according to claim 1,
wherein the channel member comprises
a plurality of unit channels each comprising a combination of the plurality of discharge holes, the plurality of pressurization chambers, the first shared channel, the second shared channel, and the bypass channel.

9. The fluid discharge head according to claim 8,
wherein each of the plurality of unit channels comprises
a plurality of discharge hole lines each comprising a portion of the plurality of discharge holes that are arranged,
wherein the plurality of discharge hole lines is arranged in parallel, and
wherein, as viewed in an intersecting direction with respect to the plurality of discharge hole lines, each of the plurality of discharge hole lines comprises
the portion of the plurality of discharge holes in a location between the plurality of discharge holes of others of the plurality of discharge hole lines.

10. A recording device comprising:
the fluid discharge head according to claim 9, and
a moving portion that relatively moves the fluid discharge head and a recording medium,
wherein the moving portion relatively moves the fluid discharge head and a recording medium in the intersecting direction.

11. A recording device comprising:
the fluid discharge head according to claim 1; and
a moving portion that relatively moves the fluid discharge head and a recording medium.

12. A recording device comprising:
the fluid discharge head according to claim 1;
a head chamber in which the fluid discharge head is accommodated; and
a control portion that controls at least one of temperature, humidity, and atmospheric pressure in the head chamber.

13. A recording device comprising:
the fluid discharge head according to claim 1; and
an applicator that applies a coating agent onto a recording medium.

14. A recording device comprising:
the fluid discharge head according to claim 1; and
a dryer that dries a recording medium.

15. A fluid discharge head comprising:
a channel member comprising
a plurality of discharge holes,
a plurality of pressurization chambers individually linked to the plurality of discharge holes,
a first shared channel linked to the plurality of pressurization chambers, and
a second shared channel linked to the plurality of pressurizing chambers; and
a plurality of pressurization portions that individually pressurizes the plurality of pressurization chambers,
wherein the first shared channel opens at a plurality of first openings linked to the plurality of pressurization chambers, and the first shared channel comprises a first connection region that is a range of distribution of the plurality of first openings in a channel direction of the first shared channel,
wherein the second shared channel opens at a plurality of second openings linked to the plurality of pressurization chambers, and the second shared channel comprises a second connection region that is a range of distribution of the plurality of second openings in a channel direction of the second shared channel,
wherein the channel member further comprises
a bypass channel linked to the first connection region and the second connection region that is in parallel with the plurality of pressurization chambers,
a plurality of relay channels linking the plurality of pressurization chambers and the plurality of second openings to each other, and
wherein the plurality of relay channels each comprise
a plurality of individual channels individually linked to the plurality of pressurization chambers, and
a plurality of connection channels linking two or more of the plurality of individual channels to the second connection region, a number of the plurality of connection channels being smaller than a number of the plurality of individual channels,
wherein the bypass channel is connected to at least one connection channel of the plurality of connection channels and is linked to the second connection region via the at least one connection channel, and
wherein the bypass channel is connected to at least one relay channel of the plurality of relay channels and is linked to the second connection region via the at least one relay channel.

16. The fluid discharge head according to claim 15,
wherein the plurality of individual channels is connected to an upstream end of the connection channels, and the second shared channel is connected to a downstream end of the connection channels, and
wherein the bypass channel is connected to a connection location of the plurality of individual channels in the connection channels.

17. The fluid discharge head according to claim 16,
wherein distances from the connection location of the plurality of individual channels in the connection channels to the plurality of discharge holes each connected to a respective one of the plurality of individual channels are equal to each other.

18. A fluid discharge head comprising:
a channel member comprising
a plurality of discharge holes,
a plurality of pressurization chambers individually linked to the plurality of discharge holes,
a first shared channel linked to the plurality of pressurization chambers, and
a second shared channel linked to the plurality of pressurizing chambers; and
a plurality of pressurization portions that individually pressurizes the plurality of pressurization chambers,
wherein the first shared channel opens at a plurality of first openings linked to the plurality of pressurization chambers, and the first shared channel comprises a first connection region that is a range of distribution of the plurality of first openings in a channel direction of the first shared channel,
wherein the second shared channel opens at a plurality of second openings linked to the plurality of pressurization chambers, and the second shared channel comprises a second connection region that is a range of distribution of the plurality of second openings in a channel direction of the second shared channel,
wherein the channel member further comprises
a bypass channel linked to the first connection region and the second connection region that is in parallel with the plurality of pressurization chambers,
wherein the bypass channel comprises a plurality of bypass channels,
wherein the channel member comprises the plurality of pressurization chambers and the plurality of bypass channels with a pitch in which the plurality of bypass channels are disposed at a ratio of one each per a predetermined number of the plurality of pressurization chambers in the channel direction of the first shared channel, and
wherein channel resistance of a path from the first shared channel to the second shared channel via one bypass channel of the plurality of bypass channels is ½ times or more and two times or less channel resistance of a path from the first shared channel to the second shared channel via the predetermined number of the plurality of pressurization chambers.

* * * * *